US006571769B2

(12) United States Patent
Uemura

(10) Patent No.: US 6,571,769 B2
(45) Date of Patent: Jun. 3, 2003

(54) CAPACITOR DISCHARGE TYPE INTERNAL COMBUSTION ENGINE IGNITION DEVICE

(75) Inventor: Kiyoshi Uemura, Shizuoka-ken (JP)

(73) Assignee: Kokusan Denki Co., Ltd., Shizuoka-Ken (JP)

( * ) Notice: Subject to any disclaimer, the term of this patent is extended or adjusted under 35 U.S.C. 154(b) by 0 days.

(21) Appl. No.: 10/207,605

(22) Filed: Jul. 29, 2002

(65) Prior Publication Data

US 2003/0029420 A1 Feb. 13, 2003

(30) Foreign Application Priority Data

Aug. 7, 2001 (JP) ..... 2001-239626

(51) Int. Cl.[7] ..... F02P 5/00

(52) U.S. Cl. ..... 123/406.57; 123/598; 123/179.5

(58) Field of Search ..... 123/406.57, 406.56, 123/406.58, 406.59, 406.11, 598, 174.5

(56) References Cited

U.S. PATENT DOCUMENTS 3,736,914 A * 6/1973 Schmaldienst et al. ..... 123/598
4,402,298 A * 9/1983 Morita ..... 123/406.56
4,462,363 A * 7/1984 Nanjyo et al. ..... 123/406.56
4,911,126 A * 3/1990 Notaras et al. ..... 123/406.54

* cited by examiner

*Primary Examiner*—Bibhu Mohanty
(74) *Attorney, Agent, or Firm*—Pearne & Gordon LLP

(57) ABSTRACT

A capacitor discharge type internal combustion engine ignition device is provided; wherein a capacitor is charged by a positive half-wave output voltage of an exciter coil; wherein an ignition is performed by giving an ignition signal to a thyristor from an ignition control portion for steady state; wherein a pulse signal obtained by waveform-shaping a negative half-wave output voltage of the exciter coil or the signal generated by a signal generator is given to the thyristor as the ignition signal through an ignition control portion for extremely low speed state so as to perform an ignition at a starting time and at an extremely low speed state; and wherein a power supply circuit which gives a power supply voltage to the ignition control portion for steady state and the power supply circuit which gives the power supply voltage to the ignition control portion for extremely low speed state are provided separately whereby the ignition signal for the starting time and the extremely low speed state can be generated at low speed so that the starting characteristic of the engine is improved.

6 Claims, 11 Drawing Sheets

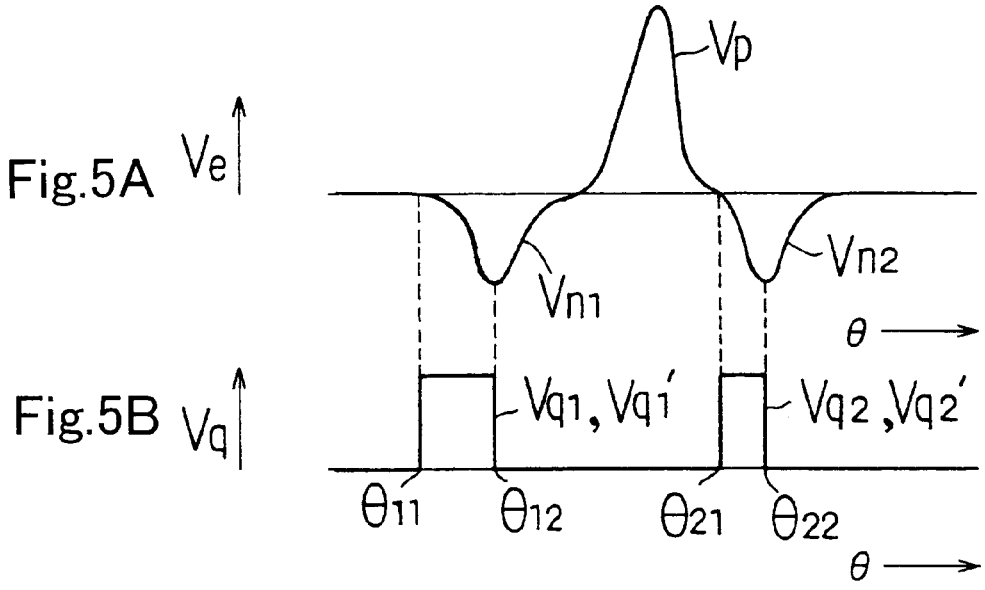
Fig.5A
Ve
Vp
Vn1
Vn2
θ
Fig.5B
Vq
Vq1, Vq1'
Vq2, Vq2'
θ11
θ12
θ21
θ22
θ
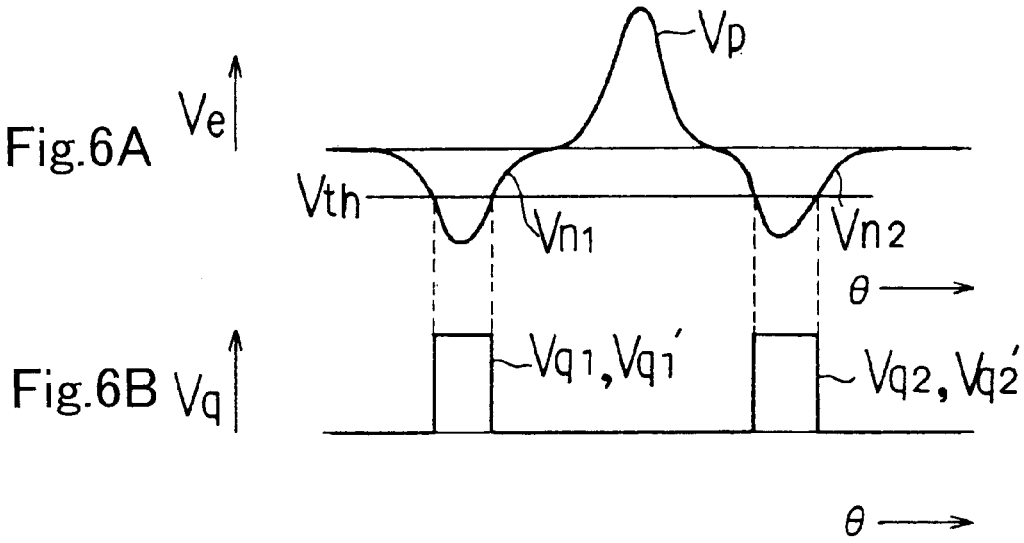
Fig.6A
Ve
Vp
Vth
Vn1
Vn2
θ
Fig.6B
Vq
Vq1, Vq1'
Vq2, Vq2'
θ

Fig.7A Ve
Fig.7B Vc1
Fig.7C Vdc
Fig.7D Vq
Fig.7E Vih

Fig.7G Vis
Fig.7H Vci
Vp
Vn1
Vn2
360°
Vz
Vc1
+5V
0
θ
Vq1
Vq2
Vq1(Vq1')
Vq2(Vq2')
Vih1
Vih2
θ11
θ12
θ21
θ22
θ0
T1
T2
T360
Ti8
Ts
Th

CAPACITOR DISCHARGE TYPE INTERNAL COMBUSTION ENGINE IGNITION DEVICE

TECHNICAL FIELD OF THE INVENTION

The present invention relates to a capacitor discharge type internal combustion engine ignition device.

BACKGROUND OF THE INVENTION

A capacitor discharge type internal combustion engine ignition device is comprised of an ignition coil; an ignition capacitor provided at the primary side of the ignition coil and charged by an output voltage of a predetermined power supply at one polarity; a discharge thyristor, which becomes an on-state when an ignition signal is given and discharges a charge of the ignition capacitor through the primary coil of the ignition coil; a signal generating portion for generating a signal to obtain rotational information on the internal combustion engine; and an ignition control portion which gives the ignition signal to the discharge thyristor at an ignition position (a rotational angle position of a crank shaft at a time of performing an ignition operation) of the internal combustion engine decided based on the rotational information obtained from the signal generated by the signal generating portion.

As for the power supply to charge the ignition capacitor, an exciter coil is often used, which is provided inside a magneto-generator driven by the internal combustion engine and synchronizes with rotation of the engine so that an alternating voltage is induced.

In recent years, in order to purify an exhaust gas of the engine and attempt to reduce a fuel cost, it is necessary for the engine to have complex ignition characteristics. For this reason, there are frequent cases where a microcomputer is installed in the ignition control portion and the ignition position is decided in a software manner.

In the case where the ignition signal is generated at the ignition position decided in the software manner by using the microcomputer, a reference position is set at a position sufficiently advanced more than the rotational angle position corresponding to a top dead center of the internal combustion engine, and a time required for the engine to rotate to the ignition position arithmetically operated from the reference position is found as an ignition position detection time (time to be measured by the ignition timer for detecting the ignition position). When the reference position is detected, an ignition timer is allowed to start measuring the ignition position detection time and generate the ignition signal when the measurement has been completed.

As described above, in the internal combustion engine which controls the ignition position by using the microcomputer, since it is necessary to detect the reference position as the basis for measuring the ignition position decided in the software manner and the ignition position at a starting time and an extremely low speed state, the signal generating portion is comprised in such a manner that a reference position detection signal is generated at the reference position set at a position sufficiently advanced more than the rotational angle position of the crank shaft corresponding to the top dead center of the engine, and the ignition position detection signal for extremely low speed state is generated at the position adequate as the ignition position at the starting time and the extremely low speed state of the internal combustion engine.

Further, the ignition control portion is provided with an ignition control portion for extremely low speed state for giving the ignition signal to the discharge thyristor when the ignition position detection signal for extremely low speed state is generated and an ignition control portion for steady state for giving the ignition signal to the discharge thyristor at the ignition position decided based on the rotational information on the internal combustion engine, which is obtained from the output signal of the signal generating portion.

In the case where the ignition position is decided by using the microcomputer, if a battery is provided, the microcomputer can be operated from the starting time of the engine and, therefore, there arises no problem at all. However, in the case where no battery is provided or in the case where there is a necessity to make it possible to operate the engine even when the battery is exhausted for safety reason, it is necessary to give a power supply voltage to the microcomputer by an output of a generator mounted on the engine. For example, in an outboard motor, the engine is required to operate even when the battery is exhausted. For this reason, in the ignition device of this type, a control power supply circuit is provided, which rectifies a negative half-wave output of the exciter coil not used for charging the ignition capacitor and generates a constant direct current voltage so that, from this power supply circuit, the power supply voltage is given to the ignition control portion.

In a battery-less ignition device having a microcomputer provided with power voltage from the output of the control power supply circuit fed by the generator mounted on the internal combustion engine instead of a battery, since the microcomputer is not allowed to normally operate until the output voltage of the generator is raised to a certain level at a starting time of the engine, the ignition operation can not be performed as long as the rotational speed of the internal combustion engine is low. Further, even when the microcomputer can be normally operated, as long as the rotational speed of the engine is low, since fluctuation in the rotational speed accompanied by a stroke change of the engine is large, it is difficult to accurately measure the ignition position arithmetically operated by the microcomputer, thereby it is not possible to stably perform the ignition operation.

For this reason, in the battery-less ignition device, a signal is generated from the generator or a signal generator mounted on the engine at a position adequate as the ignition position at the starting time and the extremely low speed state of the engine, and when this signal has been generated, the ignition signal is given to the discharge thyristor through a hardware circuit, so that an ignition at the starting time and the extremely low speed state (a speed region below an idling rotational speed) is stably performed.

As described above, in the battery-less capacitor discharge type ignition device which decides the ignition position in the software manner by using the microcomputer, in order to stably perform the ignition at the starting time and the extremely low speed state of the engine, the ignition control portion for extremely low speed state is provided, wherein the ignition signal is given to the discharge thyristor through the hardware circuit. However, in a conventional ignition device of this type, since the power supply voltage was given to the ignition control portion for steady state provided with the microcomputer and to the ignition control portion for extremely low speed state from the same power supply circuit, there was a problem that the ignition control portion for extremely low speed state delays in starting an operation at the starting time of the engine.

That is, since the microcomputer constantly consumes electric power, when the rotational speed of the engine is low and a peak value of the negative half wave output voltage of the exciter coil is not in a sufficiently high level state (in a state whereby the peak value of the output voltage of the negative half-wave of the exciter coil barely reaches the power supply voltage of the microcomputer), even if the power supply circuit outputs the voltage of a value (5V) necessary for operating the microcomputer while the exciter coil generates the negative half-wave output voltage, the output of the control power supply circuit stops as soon as the exciter coils enters a time period for outputting a positive half-wave voltage. Accordingly, until the control power supply circuit, which drives the microcomputer, is put into a state of stably outputting a voltage held at a set value, it is necessary to wait until the rotational speed of the engine is further increased so that the output voltage of the exciter coil is increased. For this reason, in the case where the power supply voltage is given to the ignition control portion for extremely low speed state by the same power supply circuit as the power supply circuit driving the microcomputer, there arose problems that a start of the operation of the ignition control portion for extremely low speed state is delayed, a starting characteristic of the engine is deteriorated and an ignition operation at an idling time is unstable.

SUMMARY OF THE INVENTION

Hence, an object of the present invention is to provide a capacitor discharge type internal combustion engine ignition device, wherein a rotational speed of which the ignition control portion for extremely low speed state starts an operation is sufficiently lowered so that a starting characteristic of the internal combustion engine can be improved and an idling rotation can be stably performed.

The present invention is applied to a capacitor discharge type internal combustion engine ignition device which comprises: an exciter coil provided inside a magneto-generator to be driven by an internal combustion engine; an ignition coil; an ignition capacitor provided at an primary side of the ignition coil and charged by a positive half-wave output voltage of the exciter coil at one polarity; a discharge thyristor which becomes an on-state when an ignition signal is given and discharges a charge of the ignition capacitor through the primary coil of the ignition coil; a control power supply circuit which converts the output voltage of the exciter coil into a direct current voltage; a signal generating portion for generating a reference position detection signal at a reference position set at a position sufficiently advanced more than a rotational angle position of a crank shaft which corresponds to a top dead center of the internal combustion engine and generating an ignition position detection signal for extremely low speed state at a position adequate as an ignition position at the starting time and the extremely low speed state of the internal combustion engine; an ignition control portion for extremely low speed state for giving an ignition signal to the discharge thyristor when the ignition position detection signal for extremely low speed state is generated; and an ignition control portion for steady state for giving the ignition signal to the, discharge thyristor at the ignition position decided based on rotational information on the internal combustion engine obtained from an output signal of the signal generating portion, and the ignition control portion for extremely low speed state and the ignition control portion for steady state operate with a direct current power supply voltage which is obtained by the control power supply circuit.

The present invention provides a first power supply circuit for generating a constant direct current voltage for operating the ignition control portion for steady state when the output voltage of the exciter coil is equal to or more than a set value and a second power supply circuit for generating the direct current voltage for operating the ignition control portion for extremely low speed state since when the output voltage of the exciter coil is in a state of being below the set value.

Further, the ignition control portion for extremely low speed state is comprised in such a manner as to start the operation at the power supply voltage lower than the power supply voltage (usually 5V) of the ignition control portion for steady state.

Since the ignition control portion for extremely low speed state consumes electric power only for a few period when the ignition signal for extremely low speed state is generated, even when a rotational speed of the engine is low and the exciter coil is in a state where an output necessary for stably operating the ignition control portion for steady state is unable to be generated from the first power supply circuit, the power supply voltage necessary for operating the ignition control portion for extremely low speed state can be stably generated from the second power supply circuit. For this reason, as described above, when the second power supply circuit for exclusive use of the ignition control portion for extremely low speed state is provided, the operation of the ignition control portion for extremely low speed state can be started at a rotational speed lower than the rotation speed whereby the ignition control portion for steady state starts the operation so that the starting characteristic of the engine can be improved and an idling rotation can be stably performed.

As for the magneto-generator used for operating the capacitor discharge type internal combustion engine ignition device, a magneto-generator is frequently used, which comprises: a magnetic rotor having a rotational body mounted on a crank shaft of the internal combustion engine and one permanent-magnet mounted on an outer periphery of the rotor and comprising a three pole magnetic field by the permanent-magnet and an outer periphery portion of the rotational body abutting against the permanent-magnet; and a stator having an iron core with a magnetic pole portion opposing to the magnetic filed of the magnetic rotor and an exciter coil wound around the iron core, which outputs from the exciter coil an alternating current voltage of one and a half cycle where a first negative half-wave voltage and positive half-wave voltage and a second negative half-wave voltage appear in order.

In the case where such a magneto-generator is used, the signal generating portion can be comprised of the exciter coil and a waveform shaping circuit which waveform-shapes the first and the second negative half-wave voltages outputted by the exciter coil, respectively and converts them into the first and the second pulse signals of a rectangular waveform shape.

In this case, the magneto-generator is provided so that a rising edge position or a falling edge position of the second pulse signal corresponds to a position adequate as an ignition position at the starting time and the extremely low speed state of the internal combustion engine.

Further, taking each rising edge or falling edge of the first and the second pulse signals as the ignition position detection signal for the extremely low state, the ignition control portion for extremely low speed state is comprised so as to provide an ignition signal to the discharge thyristor at the position where the rising edge or the falling edge of the first pulse signal is appeared and where the rising edge or the falling edge of the second pulse signal is appeared. This ignition control portion for extremely low speed state is comprised of a hardware circuit.

The ignition control portion for steady state is comprised so that a microcomputer operates with the direct current voltage obtained from the first power supply circuit, and taking the rising edge or the falling edge of the first pulse signal as the reference position detection signal, the microcomputer performs an arithmetical operation of the ignition position in each rotational speed of the internal combustion engine and a detection of the operated ignition position, and the microcomputer gives the ignition signal to the discharge thyristor when the operated ignition position is detected.

When comprised as described above, even before the exciter coil generates the positive half-wave output voltage (before the ignition capacitor is charged), the ignition signal is given to the discharge thyristor. However, even though the ignition signal is given with the ignition capacitor being in a non-charged state, the discharge thyristor is not the on-state, so an ignition operation is not performed, thereby no trouble occurs for the ignition of the engine.

When comprised as described above, since there is no need to provide a signal generator separately from the magneto-generator, the ignition position can be decided by the arithmetical operation without the constitution of the engine made complex, so that the internal combustion engine ignition device capable of dealing with various ignition characteristics can be obtained.

In the present specification, the ignition signal given to the discharge thyristor from the ignition control portion for extremely low speed state comprising the hardware circuit is referred to as "a hardware ignition signal" in a sense that it is the ignition signal given from the hardware circuit. Further, the ignition operation performed by the hard ignition signal is referred to as a hard ignition.

On the other hand, the ignition signal given to the discharge thyristor at the ignition position arithmetically operated by allowing the microcomputer to execute a predetermined software is referred to as "a soft ignition signal" in a sense that it is the ignition signal to be generated at the ignition position decided in the software manner. Further, the ignition operation performed by the soft ignition signal is referred to as a soft ignition.

In a preferred mode of the present invention, an ignition signal cancel switch is further provided, which becomes an on-state when the cancellation command is given and bypasses the ignition signal given to the discharge thyristor from the ignition control portion for extremely low speed state. In this case, the microcomputer of the ignition control portion for steady state is programmed in such a manner as to comprise: reference position detection means for discriminating the first pulse signal and the second pulse signal from signal widths of the first and the second pulse signals and intervals of generating the first and the second pulse signals and detecting the rising or the falling edge of one of the discriminated signals as the reference position; rotational speed detection means for finding the data to detect the rotational speed of the internal combustion engine by using at least one of the first and the second pulse signals; ignition position arithmetical operation means for arithmetically operating the ignition position of said internal combustion engine for the detected rotational speed in the form of a time required for the crank shaft of the engine to rotate from said reference position to the ignition position; ignition position detection means for starting measurement of the ignition position when the reference position is detected and giving the ignition signal to the discharge thyristor when the measurement of the ignition position has been completed; and cancellation command generating means for generating a cancellation command when the rotational speed of the internal combustion engine exceeds a set value.

In the case where the cancel switch is provided as described above and the rotational speed of the internal combustion engine exceeds the set value and the microcomputer is in an operating state, when the cancel switch is the on-state so that the ignition signal given to the discharge thyristor from the ignition control portion for extremely low speed state is bypassed from the discharge thyristor, the discharge thyristor becomes the on-state by the ignition signal given to the discharge thyristor by the falling or the rising of the first pulse signal at the steady time operating time, thereby making it possible to put the ignition capacitor into a state of not being charged and prevent the engine from causing an accidental fire.

The ignition control portion for extremely low speed state may comprises: an ignition signal supply capacitor charged by the output voltage of the second power supply circuit through a current limiting element and between a gate and a cathode of the discharge thyristor; a transistor provided in such a manner as to become an on-state the first and the second pulse signals as base signals and bypass the charge current of the ignition signal supply capacitor from the capacitor; and a diode for linking between the ignition signal supply capacitor and the transistor so that the charge of the ignition signal supply capacitor is discharged through the transistor when the transistor is the on-state, wherein the ignition signal is given to the discharge thyristor by the falling edges of the first pulse signal and the second pulse signal.

In the above described example, though the negative half-wave output voltage is shaped into a pulse waveform so as to obtain the reference position detection signal and the ignition position detection signal for extremely low speed state, the reference position detection signal and the ignition position detection signal for extremely low speed state may be obtained from the output of the signal generator mounted on the internal combustion engine. In this case, the signal generating portion is mounted on the internal combustion engine, and can be comprised of a signal generator for generating a first signal when the rotational angle position of the crank shaft of the engine corresponds to the reference position and generating a second signal when the rotational angle position of the internal combustion engine corresponds to the position adequate as the ignition position at the starting time and the extremely low speed state and a waveform shaping circuit for shaping the first and the second signals outputted by the signal generator into predetermined waveforms, respectively and outputting them as the reference position detection signal and the extremely low speed state ignition detection signal.

BRIEF DESCRIPTION OF THE DRAWINGS

The above and other objects and features of the invention will be apparent from the detailed description of the preferred embodiment of the invention, which is described and illustrated with reference to the accompanying drawings, in which;

FIGS. 5A and 5B are waveform charts for explaining an operation of a waveform shaping circuit to be used in the embodiment of FIG. 1;

FIGS. 6A and 6B are waveform charts for explaining the operation of the waveform shaping circuit to be used in the embodiment of FIG. 2;

FIGS. 7A to 7E, FIGS. 7G and 7H are waveform charts wherein a voltage waveform of each portion of the embodiment shown in FIG. 1 and the embodiment shown in FIG. 2 is shown for a rotational angle of a crank shaft of the engine;

DETAILED DESCRIPTION OF PREFERRED EMBODIMENTS

Figure 4A:
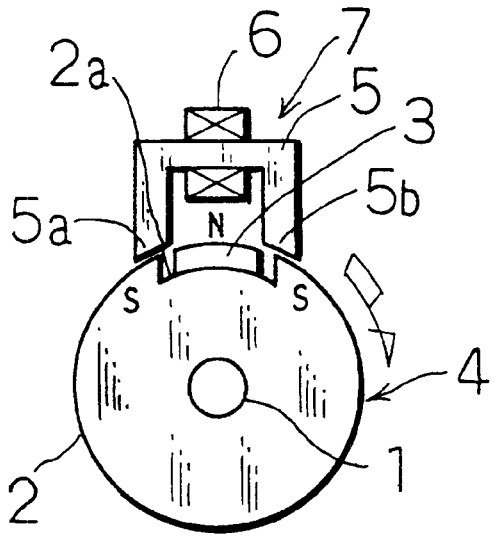
FIG. 4A is a schematic front elevation showing the constitution of a magneto-generator to be used for an ignition device according to the present invention.

In the present invention, an ignition capacitor is charged by an output of an exciter coil provided in a magneto-generator to be driven by an internal combustion engine. As for the magneto-generator to be used for an internal combustion engine ignition device, a magneto-generator shown in FIG. 4A is often used. This magneto-generator has a rotational body 2 of a cup shape mounted on a crank shaft 1 of the internal combustion engine and one permanent-magnet 3 mounted in a concave portion 2*a* provided on peripheral of said rotational body and magnetized in a radial direction of the rotational body, and comprises a magnetic rotor 4 comprising a three pole magnetic field by the permanent-magnet 3 and the outer periphery of the rotational body 2 abutting against the permanent-magnet and a stator 7 comprised of an exciter coil 6 wound around an U-shaped iron core 5 having magnetic pole portions 5*a* and 5*b* opposing to the magnetic field of the magnetic rotor 4. In the illustrated example, since a magnetic pole outside of the magnet 3 is an N pole, the three pole magnetic field is comprised of one N pole and two S poles formed respectively on the outer periphery portion of the rotational body at both sides of the N pole. The stator 7 is fixed to a stator attachment portion mounted on a case, a cover and the like of the engine, and the magnetic pole portions 5*a*, 5*b* of the iron core 5 are opposed to the magnetic field of the magnetic rotor 4 through an air gap.

Figure 4B:
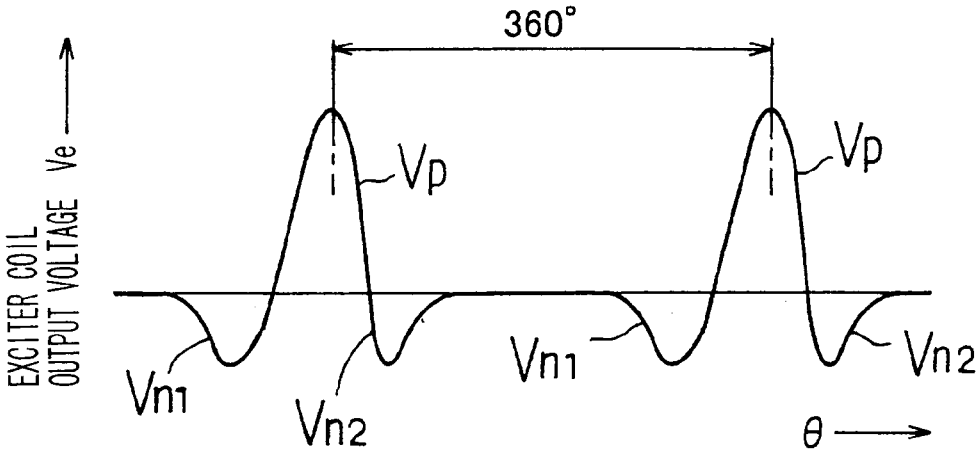
FIG. 4B is a waveform chart showing a waveform of an output voltage to be obtained from the generator shown in FIG. 4A.

This generator outputs an alternating current voltage Ve of one and half a cycle from the exciter coil 6, where, during the magnetic rotor 4 makes one rotation together with the crank shaft, the first negative half-wave voltage Vn1 and a positive half-wave voltage Vp and the second negative half-wave voltage Vn2 appear in order as shown in FIG. 4B.

In case of using the generator shown in FIG. 4A, the positive half-wave voltage Vp outputted by the exciter coil 6 is used as the voltage for charging the ignition capacitor.

Figure 1:
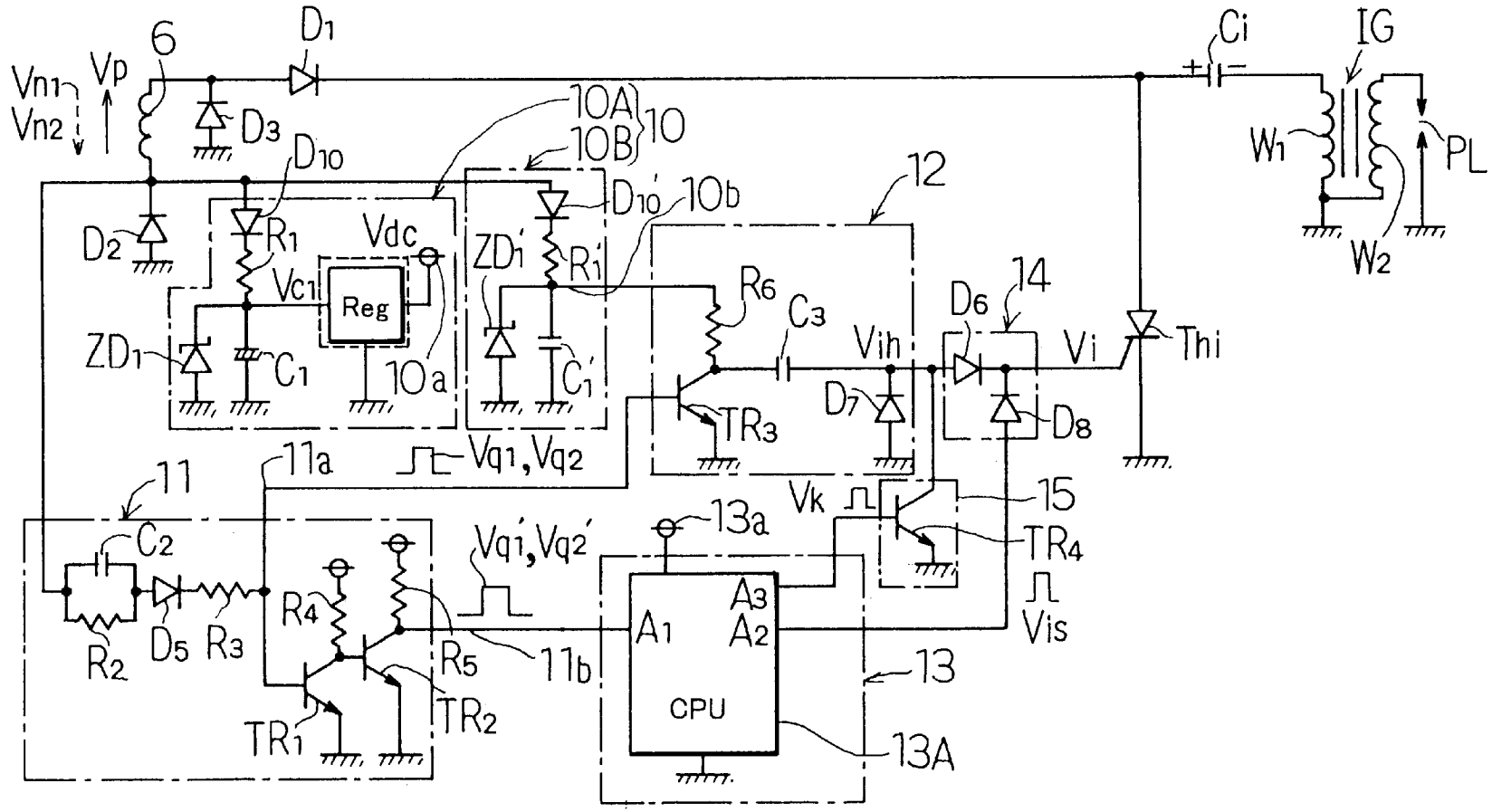
FIG. 1 is a circuit diagram showing a constitution of an embodiment of the present invention.

FIG. 1 shows a structural example of a hardware of a capacitor discharge type internal combustion engine ignition device according to the present invention. In the drawing, reference numeral 6 denotes an exciter coil provided inside the magneto-generator shown in FIG. 4A and reference numeral IG denotes an ignition coil having a primary coil W1 and a secondary coil W2. One end of the primary coil and the secondary coil of the ignition coil IG is grounded respectively, and the other end of the primary coil W1 and the other end of the secondary coil W2 are connected respectively to one end of an ignition capacitor Ci and a non-grounded side terminal of an ignition plug PL mounted on a cylinder head not shown of the engine.

As shown in FIG. 4B, the exciter coil 6 outputs the alternating current voltage Ve where, during the magnetic rotor 4 (see FIG. 4A) makes one rotation together with the crank shaft 1, the first negative half-wave voltage Vn1 and positive half-wave voltage Vp and the second negative half-wave voltage Vn2 appear in order. Note that θ of a horizontal axis in FIG. 4B shows a rotational angle of the crank shaft.

The other end of the ignition capacitor Ci is connected to an anode of a discharge thyristor Thi whose cathode is grounded, and is connected to one end of the exciter coil 6 through a diode D1, whose cathode is directed to the ignition capacitor side. The other end of the exciter coil 6 is connected to a cathode of a diode D2, whose anode is grounded, and between one end of the exciter coil 6 and the ground, a diode D3 is connected, whose anode is directed to the ground side.

In the illustrated example, an ignition circuit is comprised, wherein an essential portion of the ignition device is formed by the ignition coil IG, the ignition capacitor Ci and the discharge thyristor Thi. Further, a charging power supply portion of the ignition capacitor Ci is comprised of the exciter coil 6 and the diode D1 to D3.

In the illustrated ignition circuit, the ignition capacitor Ci is charged to the illustrated polarity by the positive half-wave output voltage of the exciter coil 6 through the diode D1. When the capacitor Ci is in a state of being charged to the illustrated polarity (a state of a forward direction voltage being applied between the anode and the cathode of the tyristor Thi) and an ignition signal Vi is given to the discharge thyristor Thi from a circuit to be described later, the discharge thyristor is the on-state and, therefore, the charge of the ignition capacitor Ci is discharged through the discharge thyristor Thi and the primary coil W1 of the ignition coil IG. In this way, an ignition high voltage is induced in the secondary coil of the ignition coil IG, and since this high voltage is applied to the ignition plug PL, an electric spark is caused by the ignition plug so that the engine is ignited.

Note that, though a resistor and a capacitor for protection purpose are connected between the gate and the cathode and between the anode and the cathode of the thyristor Thi, the illustration thereof is omitted.

In the present invention, one end of a resistor R1 is connected to the other end of the exciter coil 6 through a diode D10 whose anode is directed to the exciter coil side, and a first power supply capacitor C1 is connected between the other end of the resistor R1 and the ground. To both ends of the capacitor C1, a Zener diode ZD1 whose anode is directed to the ground side is connected, and the voltage of both ends of the capacitor C1 is kept below a constant value (Zener voltage) by the Zener diode. The voltage at both ends of the capacitor C1 is inputted to a three terminal regulator Reg having a control function to keep the output voltage constant (5[V] in this example) for the fluctuation of the input voltage. The diode D10, the resistor R1, the first power supply capacitor C1, the Zener diode ZD1 and the three terminal regulator Reg comprise a first power supply circuit 10A, which converts the first and the second negative half-wave voltages Vn1 and Vn2 into the direct current voltage for control purpose, and an output terminal of the regulator Reg turns into an output terminal 10*a* of this power supply circuit 10A.

Further, one end of a resistor R1' is connected to the other end of the exciter coil 6 through a diode D10' whose anode is directed to the exciter coil side, and a second power supply capacitor C1' is connected between the other end of this resister and the ground. To both ends of the second power supply capacitor C1', a Zener diode ZD1' whose anode is directed to the ground side is connected in parallel. The diode D1', the resistor R1', the second power supply capacitor C1' and the Zener diode ZD1' comprise a second power supply circuit 10B, and a non-grounded side output terminal 10*b* is derived from a non-grounded side terminal of the capacitor C1'.

This second power supply circuit 10B generates a direct current voltage at both ends of the capacitor C1' which is controlled below the Zener voltage of the Zener diode ZD1. The Zener voltage of the Zener diode ZD1' is set lower than a control voltage of the regulator Reg.

In this example, the control power supply circuit 10 is comprised of the first power supply circuit 10A and the second power supply circuit 10B.

Figure 7F:
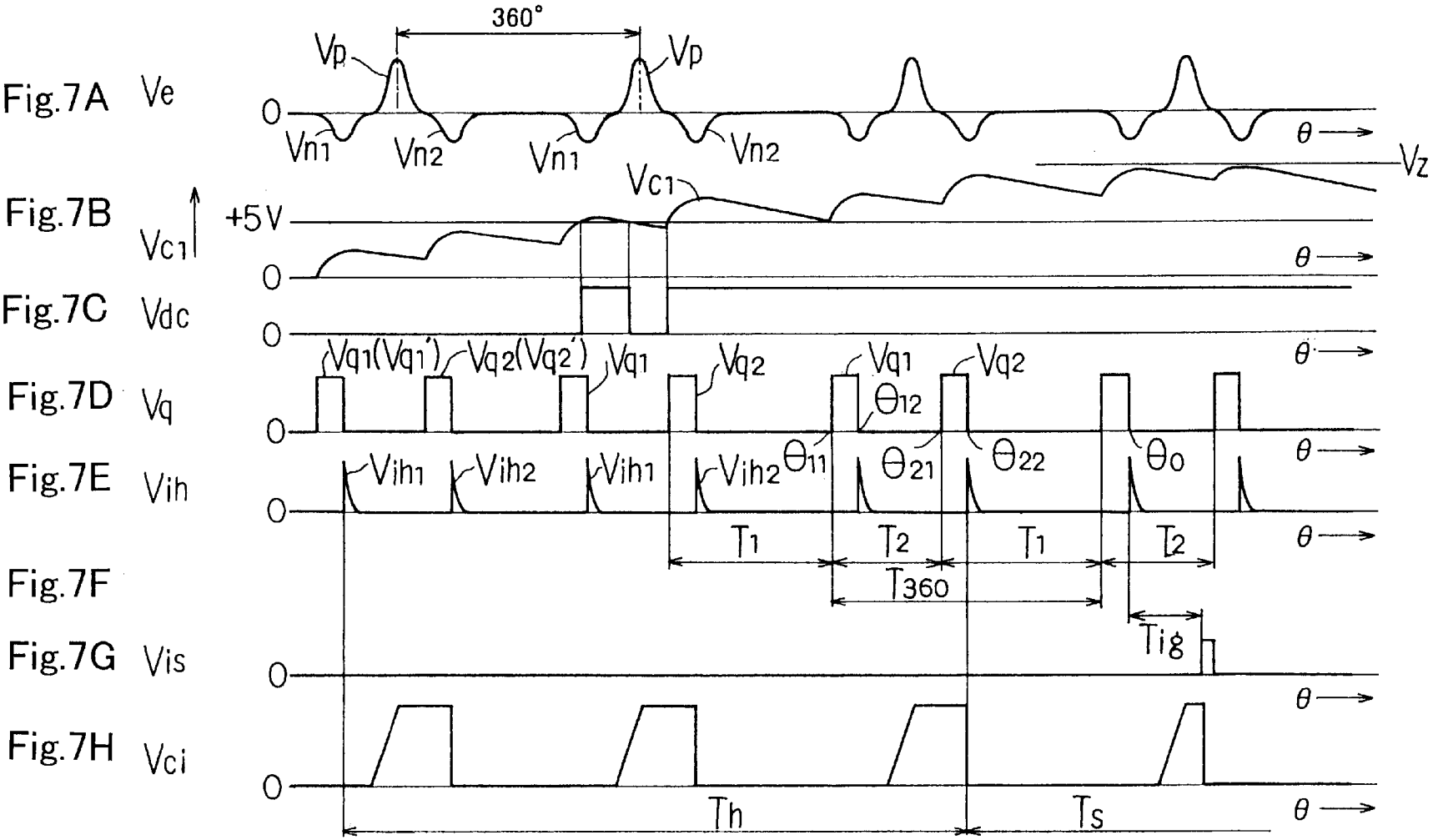
FIG. 7F is a view showing various times to be measured in the embodiments shown in FIG. 1 and FIG. 2.
Figures 8A, 8B, 8C, 8D, 8E, 8F, 8G:
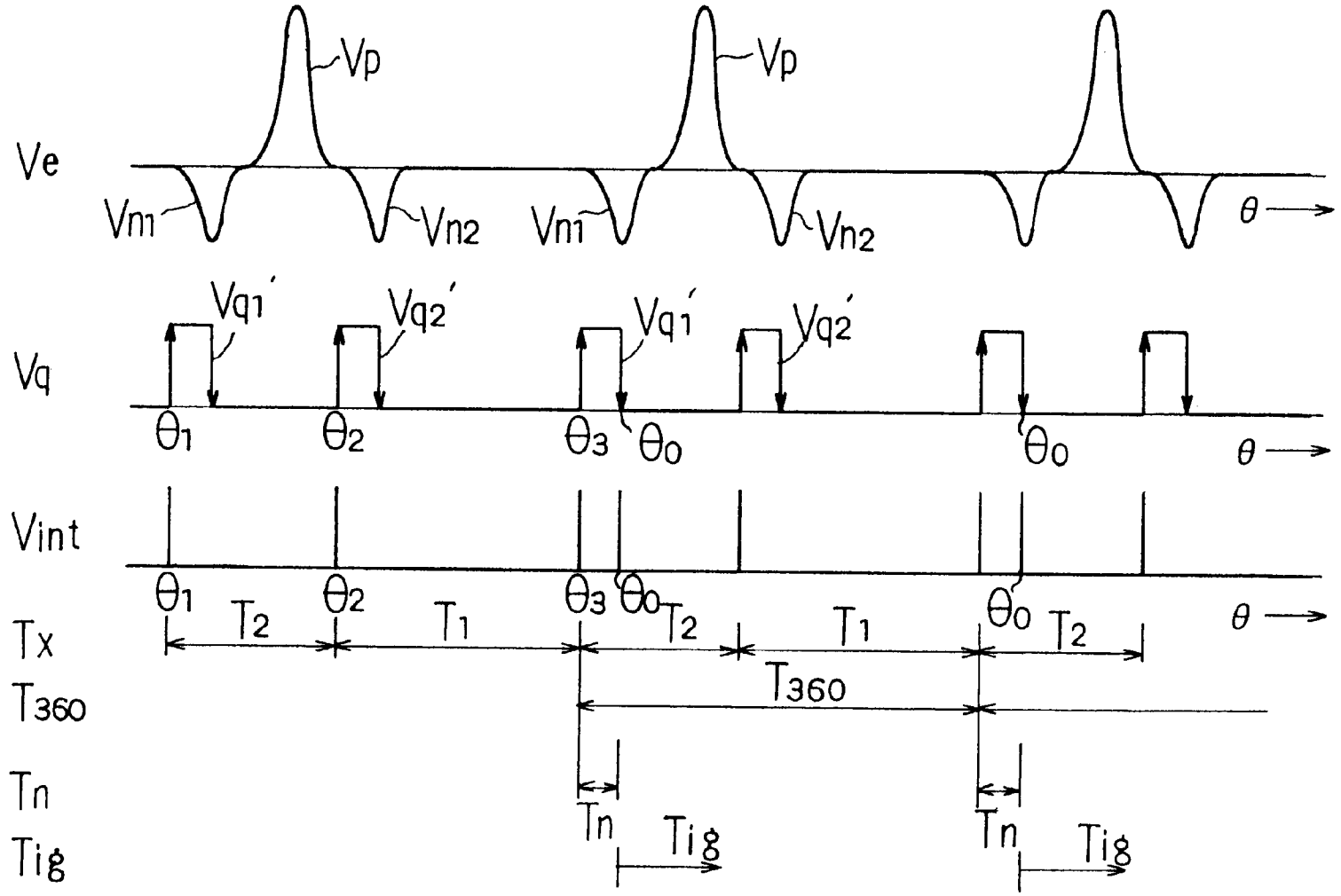
FIGS. 8A to 8C are waveform charts for explaining the operations of the embodiments of the present invention.
FIGS. 8D to 8G are views showing various times to be measured in the embodiments of the present invention.

A series of the waveforms of the voltage Ve outputted by the exciter coil 6 after the starting operation of the engine is performed and the waveforms of a voltage Vcl at both ends of the power supply capacitor C1 of the first power supply circuit 10A were shown in FIGS. 7A and 7B respectively. As shown in FIG. 7B, the terminal voltage Vcl of the capacitor C1 is increased accompanied with the increase of the rotational speed of the engine. When the rotational speed is increased to some level so that the voltage Vcl exceeds more than 5 [V] which is a control voltage of the regulator Reg, as shown in FIG. 7C, the regulator Reg outputs a constant (=5[V]) direct current voltage Vdc.

Note that, in FIG. 7B, reference character Vz denotes a Zener voltage of the Zener diode ZD1, and the terminal voltage of the capacitor C1 is limited below this Zener voltage Vz.

Further, a voltage Vci at both terminals of the ignition capacitor Ci which is charged by the positive half-wave output voltage Vp of the exciter coil 6 was shown in FIG. 7H. The ignition capacitor Ci is charged during the positive half-wave voltage Vp rises and, after that, reaches a peak, and its terminal voltage Vci is increased.

In FIG. 1, reference numeral 11 denotes a waveform shaping circuit for waveform-shaping a first and a second negative waveform voltages Vn1 and Vn2 outputted by the exciter coil 6 and converting them into a first and a second pulse signals of a rectangular waveform shape. The illustrated waveform shaping circuit 11 comprises: a capacitor C2 whose one end is connected to the other end of the exciter coil 6; a resistor R2 connected in parallel to the capacitor C2 and having a sufficiently large resistance value; a diode D5 whose anode is connected to the other end of the capacitor C2; a resistor R3 whose one end is connected to a cathode of the diode D5; an NPN transistor TR1 whose base is connected to the other end of the resistor R3 and whose emitter is grounded; an NPN transistor TR2 whose base is connected to the collector of the transistor TR1 and whose emitter is grounded; and resistors R4 and R5 connected respectively between the collectors of the transistors TR1 and TR2 and the output terminal 10*a* of the first power supply circuit 10A.

In this waveform shaping circuit 11, a first and a second output terminals 11*a* and 11*b* are derived respectively from the connecting point between the base of the transistor TR1 and the resistor R3 and from the collector of the transistor TR2.

The waveform shaping circuit 11, as shown below, detects a zero point and a peak point of each rising side of the negative half-wave voltages Vn1 and Vn2 of the exciter coil 6, and as shown in FIG. 5B and FIG. 7D, rises at the zero point of the rising side of each negative half-wave voltage, and generates a pulse signal of a rectangular waveform shape. The pulse signals of a rectangular waveform shape obtained by waveform-shaping the first negative half-wave voltage Vn1 and the second negative half-wave voltage Vn2 are taken as the first and the second pulse signals Vq1 (or Vq1') and Vq2 (or Vq2'), respectively.

That is, as shown in FIG. 5A and FIG. 7A, when the exciter coil 6 generates the negative half-wave voltage Vn1 or Vn2, the current flows through the capacitor C2, the diode D5, the resister R3 and between the base and the emitter of the transistor TR1. In this way, the transistor TR1 is put into the on-state, and the transistor TR2 is put into an off-state. At this time, since a potential of the base of the transistor TR1 and the potential of the collector of the transistor TR2 are increased, the potentials of the output terminals 11*a* and 11*b* rise to a high level state, and as shown in FIG. 5B and FIG. 7D, the pulse signal Vq1 or Vq2 rises. When the negative half-wave voltage Vn1 or Vn2 reaches a peak, a charge current does not flow into the capacitor C2 so that the transistor TR1 is put into the off-state and the transistor TR2 is put into the on-state. In this way, the potentials of the output terminals 11*a* and 11*b* rise to almost a zero level (ground potential).

Consequently, when the exciter coil 6 generates the first negative half-wave voltage Vn1, the waveform shaping circuit 11 outputs the first pulse signals Vq1 and Vq1' whose edges of the rising side and the falling side correspond respectively to the zero. point and the peak point of the voltage Vn1 from the output terminals 11*a* and 11*b*, and when the second negative half-wave voltage Vn2 is generated, it outputs the second pulse signals Vq2 and Vq2' whose edges of the rising side and the falling side corresponds respectively to the zero point and the peak point of the rising side of the voltage Vn2 from the output terminals 11*a* and 11*b*, respectively. Among these pulses, since Vq1 and Vq2 are outputted through a passive element, they are generated when the exciter coil generates the negative half-wave voltage which is equal to or more than a threshold value immediately after the starting operation of the engine begins. Accordingly, the pulse signals Vq1 and Vq2 are generated at the rotational speed sufficiently lower than the rotational speed whereby the first power supply circuit 10A generates output voltage. On the contrary, the pulse signals Vq1' and Vq2' are generated after the output voltage of the first power supply circuit 10A is established.

As described above, when a control signal of a rectangular shape is generated by waveform-shaping the negative half-wave voltage of the magneto-generator mounted on the crank shaft of the engine with a predetermined positional relationship, rising edge positions θ11, θ21 and falling edge positions θ12, θ22 of the pulse signals Vq1 (or Vq1'), Vq2 (or Vq2') correspond to a specific rotational angle position of the crank shaft.

In the present invention, as described above, the rotational information (the information on the rotational angle position and the rotational speed information) on the internal combustion engine is obtained from the rising edges or the falling edges of the first pulse signals Vq1, Vq1' and the second pulse signals Vq2, Vq2' which are obtained by waveform-shaping the negative half-wave output voltage of the exciter coil 6, so that the ignition position at the starting time and the extremely low speed state is established, and at the same time, arithmetical operation of the ignition position at a steady state driving time and detection of the arithmetically operated ignition position are performed.

In order to decide the ignition position at the starting time and the extremely low speed state of the engine, the rising or the falling edge position of any pulse signal is set to a position adequate as the ignition position at the starting time and the extremely low speed state of the engine. The ignition position at the starting time and the extremely low speed state of the engine is usually a position slightly advanced more than a top dead center (rotational angle position of the crank shaft at a time when a piston reaches the top dead center).

In order that an ignition operation is performed at the starting time and the extremely low speed state of the engine, it is necessary to give the ignition signal Vi to the discharge thyrister Thi after the ignition capacitor Ci was charged by the positive half-wave voltage Vp of the exciter coil 6. Hence, among the pulse signals, the rising edge position θ21 or the falling edge position θ22 of the second pulse signal Vq2 is allowed to correspond to the ignition position at the starting time and the extremely low speed state of the engine.

In the example shown in FIG. 1, the magnetic rotor 4 and the stator 7 are mounted on the engine so that the falling edge position θ22 of the pulse signal Vq2 is allowed to correspond to the ignition position at the starting time and the extremely low speed state of the engine. That is, the falling edge of the pulse signal Vq2 is taken as an ignition position for extremely low speed state detection signal.

In order to arithmetically operate the ignition position at the steady state, data including the information on the rotational speed of the engine is required. As for the data including the information on the rotational speed of the engine, time required for the crank shaft to make a constant angular rotation such as a period of each pulse signal, signal width of each pulse signal or intervals of two pulse signals can be used. When the ignition position is arithmetically operated, this time data may be converted into a speed or the time data may be used as it is.

Further, in order that the ignition operation is performed at the ignition position arithmetically operated at the steady state, it is necessary to be able to accurately detect the arithmetically operated ignition position. For that purpose, the rotational angle position serving as a reference of the crank shaft is established as a reference position, and the ignition position is arithmetically operated in the form of a time (time to be measured by an ignition timer) Tig required for the engine to rotate from the reference position to the ignition position at the arithmetically operated rotational speed, and when it is detected that the reference signal is generated, the ignition timer (timer provided in the microcomputer) is started, thereby measuring the ignition position. In the present specification, the time Tig which gives the ignition position is referred to as "an ignition position detection time".

Although the reference position may be at a position where the phase is advanced more than the ignition position to be measured, in order to enhance detection accuracy of the ignition position, it is desirable that the edge position of the pulse signal generated at a position as close as possible to the ignition position is taken as the reference position. Here, the edge position (same as the falling edge position of Vq1) of the first pulse signal Vq1' should be established as the reference position.

In this example, by the exciter coil 6 and the waveform shaping circuit 11, the reference position detection signal is generated at the reference position established at a position sufficiently advanced more than the rotational angle position of the crank shaft corresponding to the top dead center of the internal combustion engine, and a signal generating portion for generating the ignition position detection signal for extremely low speed state is formed at a position adequate as the ignition position at the starting time and the extremely low speed state of the internal combustion engine.

The pulse signals Vq1 and Vq2 obtained from the output terminal 11*a* of the waveform shaping circuit 11 are applied between the base and the emitter of the NPN transistor TR3 whose emitter is grounded. The collector of the transistor TR3 is connected to the output terminal 10*b* of the non-grounded side of the second power supply circuit 10B through a resistor R6, and at the same time, is connected to one end of an ignition signal supply capacitor C3, and the other end of the capacitor C3 is connected to the gate of the discharge thyristor Thi through a diode D6 whose anode is directed to the capacitor C3 side. Further, between the other end of the capacitor C3 and the ground, a diode D7 whose anode is grounded is connected.

In this example, the transistor TR3, the capacitor C3, the resistor R6 and the diode D7 comprise the ignition control portion for extremely low speed state 12, and a signal Vio outputted by this ignition control portion is given to the gate of the discharge thyristor Thi through the diode D6.

The operation of the illustrated ignition control portion for extremely low speed state 12 is as follows. When the pulse signal Vq1 or Vq2 rises and the transistor TR3 becomes the on-state, the charge accumulated in the capacitor C3 is instantaneously discharged between the collector and the emitter of the transistor TR3 and through the diode D7. In a state where the pulse signal is at a high level and the transistor TR3 is the on-state, the charging current of the capacitor C3 is bypassed from the capacitor C3 through the transistor TR3 so that the charging of the capacitor C3 is prevented. When the pulse signal Vq1 or Vq2 given in such a state falls and the transistor TR3 is put into an off-state, by the output voltage of the second power supply circuit 10B, the current flows through the resistor R6, the capacitor C3, the diode D6 and between the gate and the cathode of the discharge thyristor Thi so that the capacitor C3 is charged. By the charging current of this capacitor C3, the ignition signal is given to the discharge thyristor Thi. The ignition signal given to the discharge thyristor from the ignition control portion for extremely low speed state 12 is vanished when the charging of the capacitor C3 is completed and the charging current no longer flows.

The illustrated ignition control portion for extremely low speed state 12, in the manner as described above, gives to the discharge thyristor Thi an ignition signal Vih1 or Vih2 at the falling edge of the pulse signal Vq1 or Vq2. The width of the ignition signal Vih1 or Vih2 is sufficiently narrow. One example of the waveforms of these ignition signals was shown in FIG. 7E.

When the ignition control portion for extremely low speed state 12 gave the hard ignition signal Vih1 to the discharge thyristor Thi by the falling edge of the first pulse signal Vq1 whose phase is more advanced than the positive half-wave voltage Vp of the exciter coil, the ignition capacitor Ci is not yet charged; therefore, no ignition operation is performed. After the exciter coil 6 generates the positive half-wave voltage Vp and the ignition capacitor Ci is charged, when the hard ignition signal Vih2 is given to the discharge thyristor Thi by the falling edge of the second pulse signal Vq2, the discharge thyristor Thi becomes the on-state and the charge of the ignition capacitor Ci is discharged through the primary coil W1 of an ignition coil IG so that the ignition operation is performed.

That is, though the hard ignition signal Vih1 generated by the falling edge of the pulse signal Vq1 becomes useless, it does not exert any influence on the ignition operation.

In order to perform arithmetical operation of the rotational speed at the steady state driving time, arithmetical operation of the ignition position and detection of the arithmetically operated ignition position, an ignition control portion for steady state 13 equipped with a microcomputer 13A comprising CPU, ROM, RAM, a timer and the like is provided, and the first and the second pulse signals Vq1', Vq2' which are obtained from the output terminal 11*b* of the waveform shaping circuit 11 are inputted to one port A1 of the microcomputer 13A. A power supply terminal 13*a* of the microcomputer 13A is connected to the output terminal 10*a* of the first power supply circuit 10A, and when an output voltage Vdc of the first power supply circuit 10A is established, the microcomputer 13A is put into an operable state.

The microcomputer 13A, as described later, is programmed in such a manner as to switch a recognition mode of the signal inputted to the port A1 to a first mode to recognize the rising edge and a second mode to recognize the falling edge and, from among each edge of the pulse signals Vq1', Vq2' inputted in order, recognizes the edge necessary to obtain the rotational information on the engine. In the present embodiment, the rising and falling edges of the pulse signal Vq1' and the rising edge of the pulse signal Vq2' are recognized.

The microcomputer 13A, when its power supply voltage is established so as to put it into an operable state, first performs a processing to discriminate which signal is the first pulse signal and which signal is the second pulse signal among a series of pulse signals given from the waveform shaping circuit 11. The discrimination of the first pulse signal Vq1 and the second pulse signal Vq2 can be performed by utilizing the fact that there is a relation ship of T1>>T2 between a time T1 from the generation of the first pulse signal Vq1 to the generation of the second pulse signal Vq2 and a time T2 from the generation of the second pulse Vq2 to the generation of the next first pulse signal Vq1. For example, a pulse recognition timer for measuring time intervals between the rising edges of the pulses is provided and, as shown in FIG. 7, measurement values of the timer are read by the rising edges of the pulse signals Vq1 and Vq2 so that the times T1, T2 are measured and stored, and when there is a relationship of (T1/2)>T2 established between T1 and T2, it can be recognized that the edge at a time when the time T1 was measured is the rising edge of the first pulse signal.

As described above, when the rising edge and the falling edge of the pulse signal is recognized by one port, the required number of ports can be reduced in contrast to the case where the pulse signal Vq1' and Vq2' are read and recognized from a separate port, respectively, so that those moderate in price can be used as the microcomputer.

The other port A2 of the microcomputer 13A serves as an output port of the ignition signal, and a soft ignition signal Vis outputted from the port A2 is supplied to the gate of the discharge thyristor Thi as an ignition signal Vi through a diode D8 whose cathode is directed to the discharge thyristor side.

In this example, the diodes D6 and D8 comprise an OR circuit 14 giving the output of the ignition control portion for extremely low speed state 12 or the output of the ignition control portion for steady state 13 to the gate of the discharge thyristor Thi as the ignition signal.

Between the anode (the non-grounded side output terminal of the ignition control portion for extremely low speed state 12) of the other diode D6 comprising the OR circuit 14 and the ground, a cancel switch 15 is connected. The illustrated cancel switch 15 comprises an NPN transistor TR4 whose emitter is grounded and collector is connected to the anode of the diode D4, and to the base of this transistor TR4, a cancel command signal Vk is inputted from a port A3 of the microcomputer 13A.

The microcomputer 13A, when the rotational speed of the engine exceeds the set speed, is programmed in such a manner as to comprise cancel command generating means for generating a cancel command Vk during the rising edge of the first pulse signal Vq1' is recognized till the rising edge of the second pulse signal Vq2' is recognized, and when the ignition control portion for extremely low speed state 12 outputs an ignition signal Vio for the extremely low speed state during the cancel command is generated, the transistor TR4 becomes the on-state so that the ignition signal Vio is bypassed from the discharge thyristor Thi.

Figure 9:
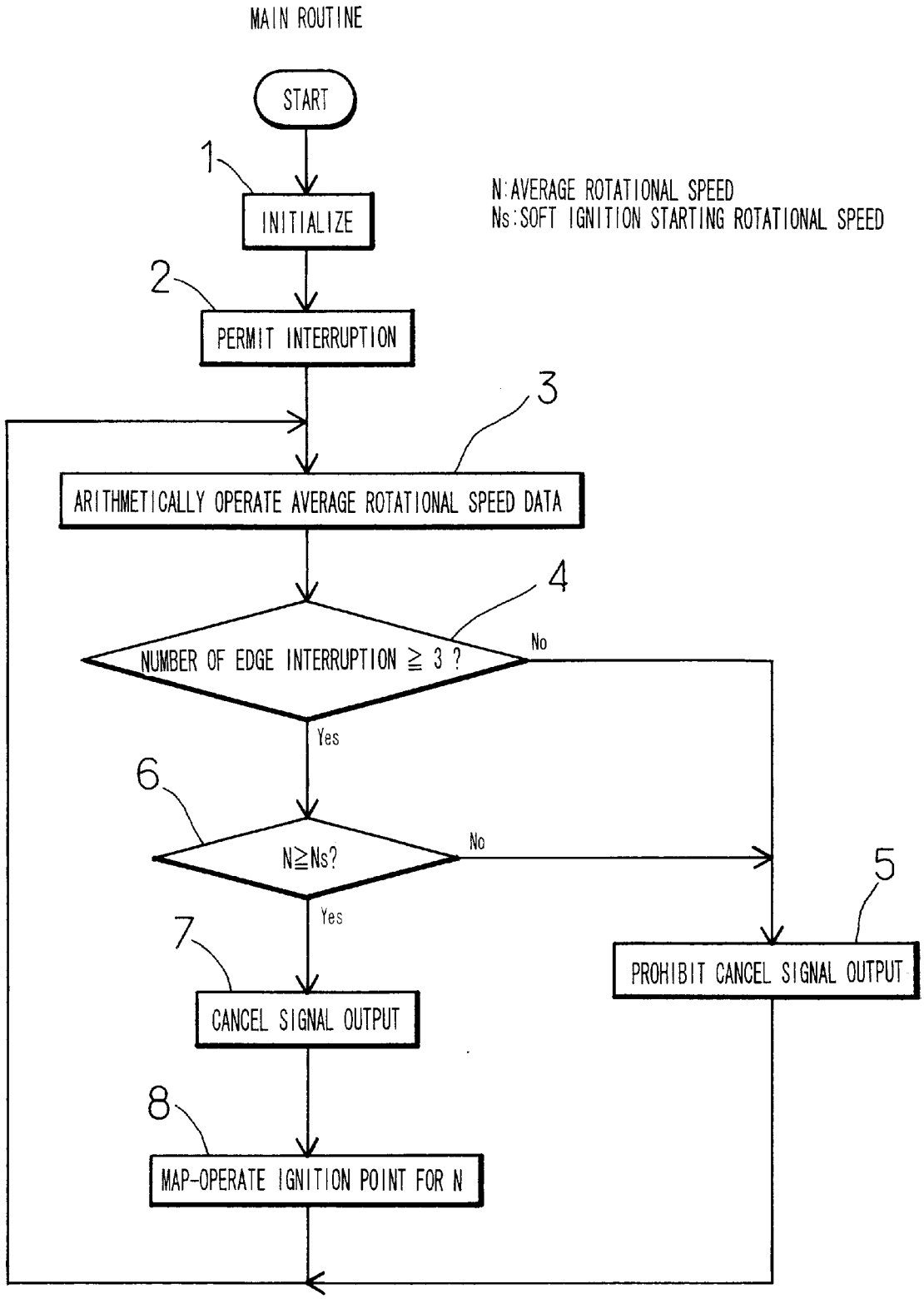
FIG. 9 is a flowchart showing one example of an algorism of a main routine of a program to be executed by a microcomputer of an ignition control portion for steady state in the embodiments of the present invention.
Figure 10:
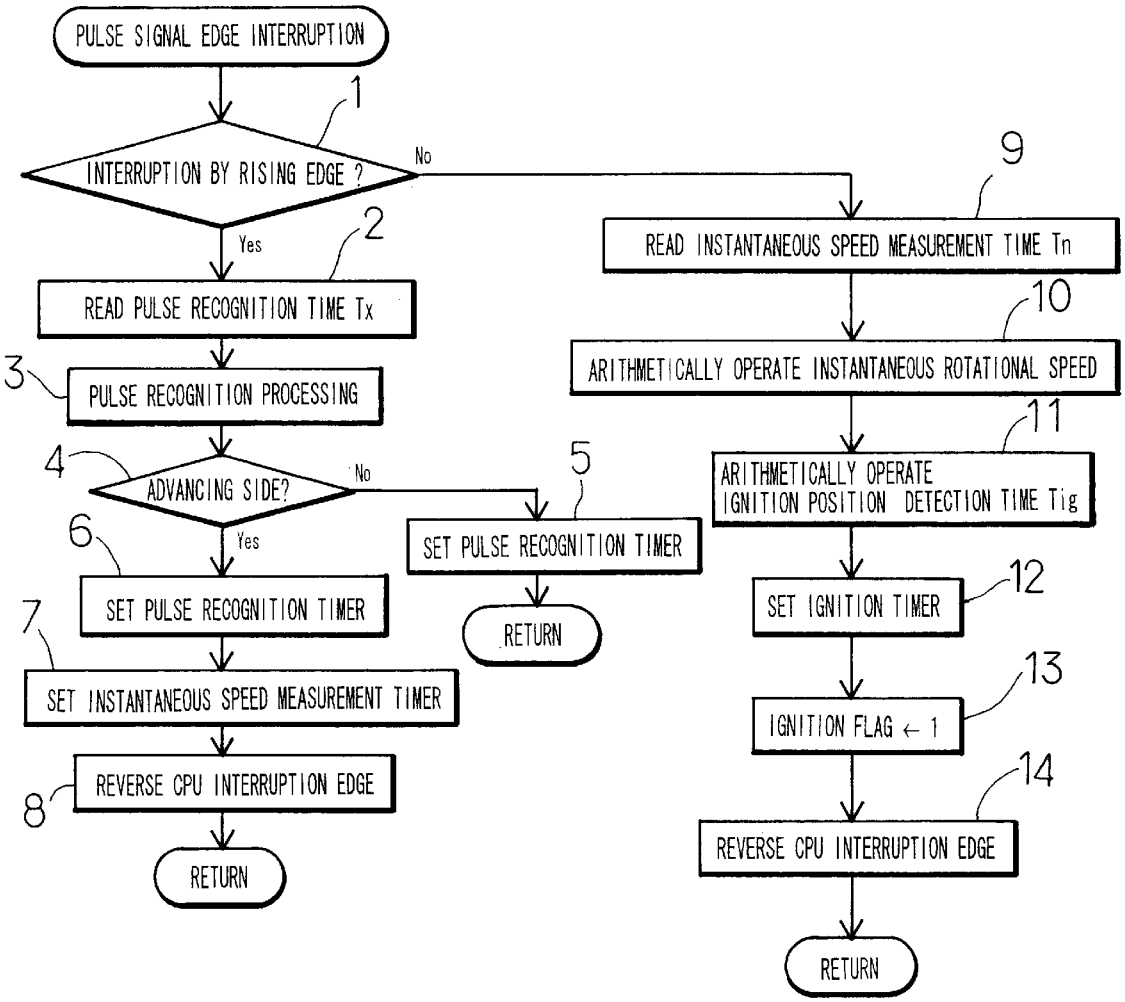
FIG. 10 is a flowchart showing one example of an algorism of a pulse edge interruption routine of the program to be executed by the microcomputer of the ignition control portion for steady state in the embodiments of the present invention.
Figure 11:
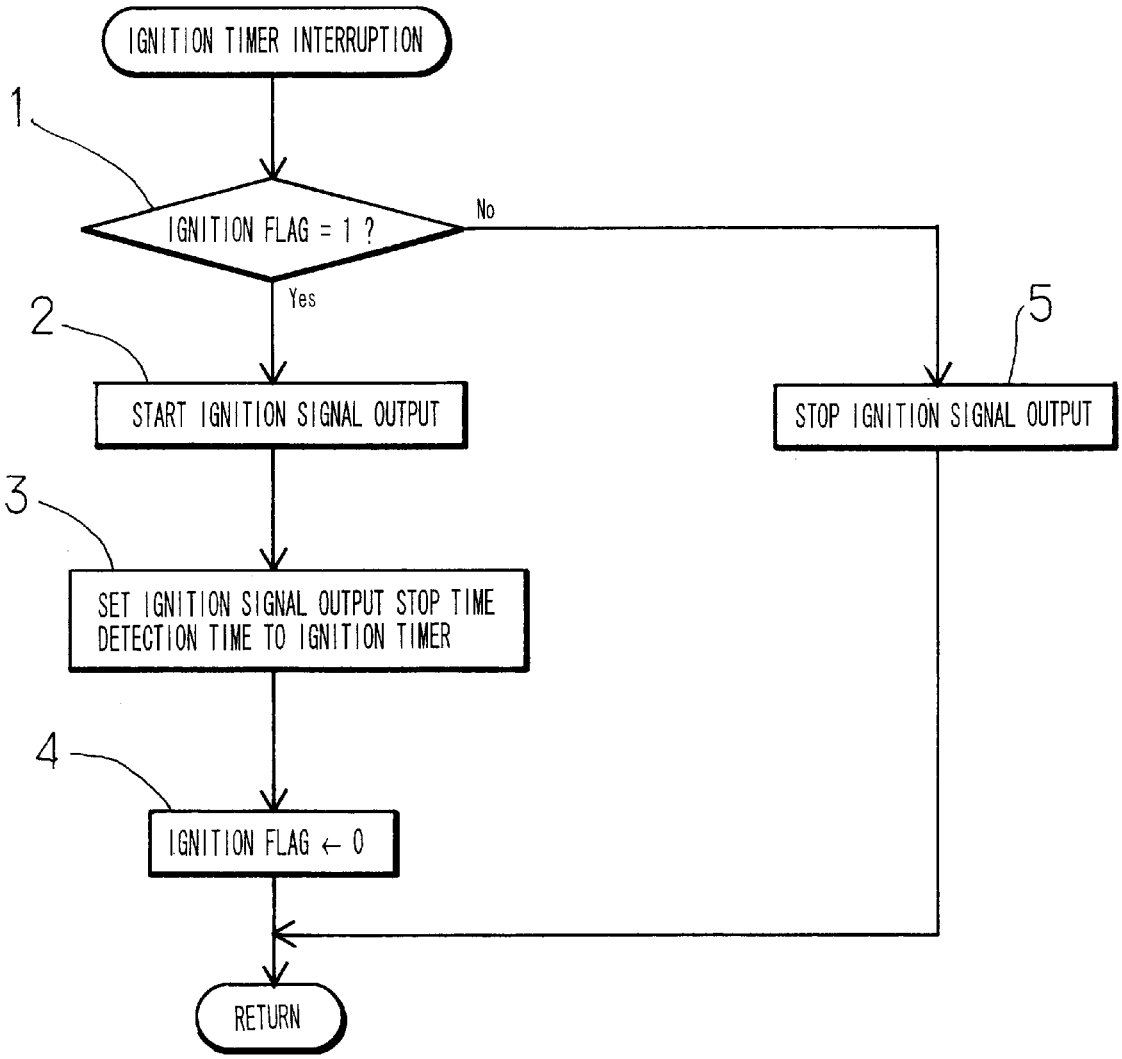
FIG. 11 is a flowchart showing one example of an algorism of an ignition timer interruption routine of the program to be executed by the microcomputer of the ignition control portion for steady state in the embodiments of the present invention.

One example of flowcharts showing an algorism of a program to be executed by the microcomputer 13A in the present embodiment was shown in FIG. 9 to FIG. 11, and a timing chart for explaining this program was shown in FIG. 8A to FIG. 8D.

FIG. 9 shows a main routine of the program to be executed by the microcomputer 13A, and FIG. 10 shows a pulse signal edge interruption routine to be executed when the rising and falling edges of the first pulse signal Vq1' is recognized and the rising edge of the second pulse signal Vq2' is recognized. Further, FIG. 11 shows an ignition timer interruption routine to be executed when the ignition timer has completed the measurement of the time set.

When the power supply of the microcomputer is established, at first, the main routine of FIG. 9 is started. In this main routine, initialization of each portion is performed first in step 1, and subsequently in step 2, interruption is permitted and, after that, in step 3, average rotational speed data of the engine is arithmetically operated. This average rotational speed data may be the time (=T1+T2) as it is, which is required for the crank shaft of the engine to make one rotation.

In step 3, after the data of the average rotational speed N was found, in step 4, whether or not the pulse signal edge interruption shown in FIG. 10 was performed more than three times is determined. As described later, in the present invention, in order to recognize the pulse signals Vq1, Vq2, it is necessary to perform the interruption routine shown in FIG. 10 three times after the microcomputer has been put into an operable state. In step 4 of the main routine, when the number of times (the edge interruption number of times) to perform the interruption of FIG. 10 is less than three times, decision is made that the recognition of the pulse signal is not yet completed, and the step advances to step 5 and prohibits the output of the cancel signal Vk.

In step 4, when decision is made that the edge interruption is performed three times or more, the step is advanced to step 6 and decision is made whether the average rotational speed N is more than the soft ignition rotational speed Ns. After that, decision is made that N<Ns, the step is advanced to step 5 and the output of the cancel signal is prohibited.

In step 6, when decision is made that N≧Ns, the step is advanced to step 7 to allow the cancel signal Vk to be outputted from the port A3, and, next, in step 8, by using an ignition position arithmetical operation map which gives a relationship between the data (time or rotational speed) giving the average rotational speed N and the ignition position, the ignition position in the arithmetically operated average rotational speed is arithmetically operated. This ignition position is arithmetically operated, for example by measuring an angle from the crank angle position corresponding to the top dead center of the engine toward an advanced angle side.

The microcomputer 13A is programmed in such a manner as to switch the recognition mode of the signal inputted to the port A1 to the first mode to recognize the rising edge of the pulse signal and the second mode to recognize the falling edge. However, in a state where initialization of each portion has been performed after the microcomputer was put into an operable state, the recognition mode of the signal to be inputted to the port A1 is switched to the first mode. For this reason, when the rising edge of the pulse signal Vq1' or Vq2' is appeared after each portion of the microcomputer has been initialized, the interruption routine of FIG. 10 is executed.

In this example, the interruption routine of FIG. 10 is taken as being executed at the position of the crank angle θ1 shown in FIG. 8. In this interruption routine, first, in step 1, decision is made as to whether or not the interruption of this time is an interruption by the rising edge. Since the pulse signal edge interruption to be initially executed is an interruption by the edge, step 2 is executed after step 1. In step 2, a pulse recognition time Tx which is a measurement value of a pulse recognition timer (a timer provided inside the microcomputer) is read and stored in a memory. Next, the step advances to step 3, and performs a pulse recognition processing. In this pulse recognition processing, the a pulse recognition time Tx−1 read last time and the pulse recognition time Tx read this time are compared, and when Tx>2×Tx−1, the pulse signal whose rising edge was recognized this time is decided as the first pulse signal Vq1', and when Tx≦Tx−½, the pulse signal whose rising edge was recognized this time is decided as the second pulse signal Vq2'.

After the pulse recognition processing was performed in step 3, the step is advanced to step 4, and decision is made as to whether or not the pulse signal inputted this time is a pulse signal of an advancing side (the first pulse signal) for the positive half-wave output voltage Vp of the exciter coil.

Since the pulse recognition timer is not set initially, the pulse recognition time Tx of the timer read in step 2 is zero, and, therefore, decision can not be made as to whether or not the pulse whose rising edge was recognized this time is the advancing side pulse. Consequently, the step is moved from step 4 to step 5, and sets the pulse recognition timer so that the measurement of the pulse recognition time Tx is allowed to start from zero, and after that, is returned to the main routine.

Next, when the rising edge of the pulse signal is inputted to the port A1 at the position of the crank angle θ2, steps 1 and 2 of the interruption routine of FIG. 10 are executed again, and the pulse recognition time Tx (T2 in the example shown in FIG. 8D) measured initially is read and stored. Subsequently, in step 3, though the pulse recognition processing is performed, since the pulse recognition time Tx is measured still only for one at this point of time, the pulse recognition processing cannot be performed as yet. For this reason, in step 4, decision cannot be made that the rising edge of this time is the rising edge of the advancing side pulse signal (the first pulse signal), so step 5 is executed. In step 5, the pulse recognition timer is set again so that the measurement of the pulse recognition time Tx is resumed.

Next, when the third pulse signal edge interruption is executed at the position of the crank angle θ3, the pulse recognition processing is made possible from the pulse recognition time Tx (T1 in the example shown in FIG. 8) measured in step 2 and the pulse recognition time Tx−1 (T2 in the illustrated example) measured last time. In this pulse recognition processing (step 3), the time TX measured this time and the time Tx−1 measured last time are compared, and when Tx>2×Tx−1, decision is made that the pulse signal whose rising edge was recognized this time is the first (advancing side) signal Vq1', and when Tx≦Tx−½, decision is made that the pulse signal whose rising edge was recognized this time is the second (delaying side) pulse signal Vq2'. In the illustrated example, since T1>2×T2, decision is made that the pulse signal whose rising edge was recognized this time is the first pulse signal Vq1' of the advancing side.

In this way, when the interruption routine of FIG. 10 is executed three times after the microcomputer was made operable, the pulse signal generated in order by the waveform shaping circuit 11 can be recognized as to be either of the first and the second pulses.

In step 4, when it is confirmed that the pulse signal whose rising edge was inputted this time was decided as the pulse signal Vq1' of the advancing side, subsequently in step 6, the pulse recognition timer is set to resume the measurement of the pulse recognition time Tx, and in step 7, an instantaneous speed measuring timer (a timer provided inside the microcomputer) is set to start the measurement of the time to obtain data of the instantaneous speed. Subsequently, in step 8, the recognition mode of the port A1 is reversed so that the port A1 of the CPU recognizes the falling edge of the input signal, and after that (after the recognition mode of the signal is switched to the second mode), the step returns to the main routine.

As described above, when the rising edge of the first pulse signal Vq1' is recognized, since the recognition:m ode of the signal to be inputted to the port A1 is switched to the mode to recognize the falling of the signal, the interruption routine of FIG. 10 is executed when the falling edge of the first pulse signal Vq1' is inputted. At this time, in step 1, since it is decided as the interruption by the falling edge, subsequently, step 9 is executed to read an instantaneous speed measurement time Tn of the instantaneous speed measuring timer set in step 7 in the interruption of the last time. Subsequently, in step 10, an instantaneous rotational speed is arithmetically operated from this measurement time Tn, and in step 11, the ignition position, which is arithmetically operated in the main routine, is converted into the ignition position detection time Tig. This ignition position detection time Tig is a time required for the crank shaft to rotate at the instantaneous rotational speed arithmetically operated in step 10 from the reference position (in this example, the falling position of the first pulse signal Vq1') to the ignition position arithmetically operated in the main routine.

In step 11, after the ignition position detection time Tig was arithmetically operated, in step 12, the ignition position detection time Tig is set in the ignition timer (the timer inside the microcomputer) to start the measurement of the ignition position. After that, in step 13, an ignition flag is set to "1" and, after that, in step 14, the signal recognition mode of the port A of the CPU is reversed to the mode to recognize the rising of the input signal (the first mode), and after that, the step returns to the main routine.

When the ignition timer completes the measurement of the ignition position detection time Tig (completes the measurement of the ignition position), the ignition timer interruption shown in FIG. 11 is executed. In this interruption routine, first, in step 1, decision is made as to whether or not the ignition flag is "1", and when the ignition flag is "1", the step advances to step 2 to start the output of the soft ignition signal. Subsequently, in step 3, an ignition signal output stop time detection time is set in the ignition timer to start the measurement thereof. Then, in step 4, after the ignition flag is set to "0", the step returns to the main routine. When the ignition timer completes the measurement of the ignition signal output stop time detection time, the ignition timer interruption shown in FIG. 11 is executed again. At this time, since the ignition flag is set to "0", step 5 is executed to stop the output of the ignition signal.

In the above described example, the ignition signal is given to the discharge thyristor Thi from the ignition control portion for extremely low speed state 12 at the starting time of the engine and at the time when the rotational speed is below a set value Ns (soft ignition starting rotational speed) so that the ignition operation is performed, and when the rotational speed of the engine has exceeded the set value Ns after the microcomputer 13A was put into an operable state, the cancel signal Vk is generated from the microcomputer to put into the on-state the transistor TR4 comprising the cancel switch, so that the hard ignition signal Vih to be given to the discharge thyristor Thi from the ignition control portion for extremely low speed state 12 is bypassed from the discharge thyristor.

When comprised in this way, the hard ignition signal can be prevented from being given to the discharge thyristor by the rising or the falling of the first pulse signal at the steady state driving time and, therefore, there is no fear of the engine causing an accidental fire due to a state developed where the ignition capacitor Ci is not charged.

In the case where the programs shown in FIG. 9 to FIG. 11 are executed by the microcomputer, reference :position detection means is comprised of step 1 to step 5 of FIG. 10, wherein the first and the second pulse signals are recognized from the signal widths of the first and the second pulse signals and the intervals of the first and the second pulse signals, and the position of the rising or the falling edge of one of the recognized pulse signals are detected as the reference position.

Further, average speed detection means is comprised of step 3 of the main routine of FIG. 9, wherein an elapsed time since when the rising edge position or the falling edge position of the first pulse signal (the rising edge in the above embodiment) is detected till the same position is detected after the crank shaft has made one rotation is found as data to detect the average rotational speed of the internal combustion engine.

Further, instantaneous speed measurement starting means is comprised of step 7 and step 8 of the interruption routine of FIG. 10, wherein a timekeeping for an instantaneous speed measurement is started when the rising edge of the first pulse signal was recognized so that the recognition mode of the signal to be inputted to the port A1 is switched to the second mode, and instantaneous speed detection means is comprised of step 9 and step 10 of the interruption routine of FIG. 10, wherein the time measured from the time when the rising edge of the first pulse signal was recognized till the time when the falling edge was recognized is found as data to detect an instantaneous rotational speed of the internal combustion engine.

Rotational speed detection means is comprised of the average speed detection means and the instantaneous speed detection means, wherein the data to detect the rotational speed of the internal combustion engine by using at least one of the first and the second pulse signals is found.

Further, ignition position arithmetically operating means is comprised of step 8 of the main routine shown in FIG. 9 and step 11 of the interruption routine of FIG. 10, wherein the ignition position of the internal combustion engine for the detected rotational speed is arithmetically operated in the form of the time required for the crank shaft of the engine to rotate from the reference position to the ignition position, and ignition position detection means is comprised of steps 12 and 13 of the interruption routine of FIG. 10 and ignition timer interruption routine of FIG. 11, wherein the measurement of the ignition position is started when the reference position is detected, the ignition signal is given to the discharge thyristor Thi when the measurement of the ignition position is completed, and cancel command generating means is comprised of steps 4 to 7 of the main routine of FIG. 9, wherein a cancel command is generated when the rotational speed of the internal combustion engine exceeds the set value.

In the capacitor discharge type ignition device, it is necessary to put the discharge thyristor into the off-state before the positive half-wave voltage of the exciter coil rises. Accordingly, like the example as described above, in the case where the hard ignition signal Vih is generated by the falling edges of the first and the second pulse signals Vq1 and Vq2 which were obtained by waveform-shaping the negative half-wave voltages Vn1 and Vn2 of the exciter coil 6, respectively, it is necessary to vanish the first and the second pulse signals Vq1 and Vq2 before the positive half-wave output voltage of the exciter coil rises.

In the example shown in FIG. 1, the waveform shaping circuit 11 was comprised in such a manner that the rising and falling edges of the first pulse signal are generated, respectively at the zero point and the peak point of the rising side of the first negative half-wave voltage outputted by the exciter coil 6, and the rising and falling edges of the second pulse signal are generated, respectively at the zero point and the peak point of the rising side of the second negative half-wave voltage outputted by the exciter coil. However, as shown in FIGS. 6A and 6B, the waveform shaping circuit 11 can be also comprised in such a manner that the first pulse signal is generated during the first negative half-wave voltage Vn1 outputted by the exciter coil exceeds a threshold level Vth, and the second pulse signal is generated during the second negative half-wave voltage outputted by the exciter coil exceeds a threshold level.

Figure 2:
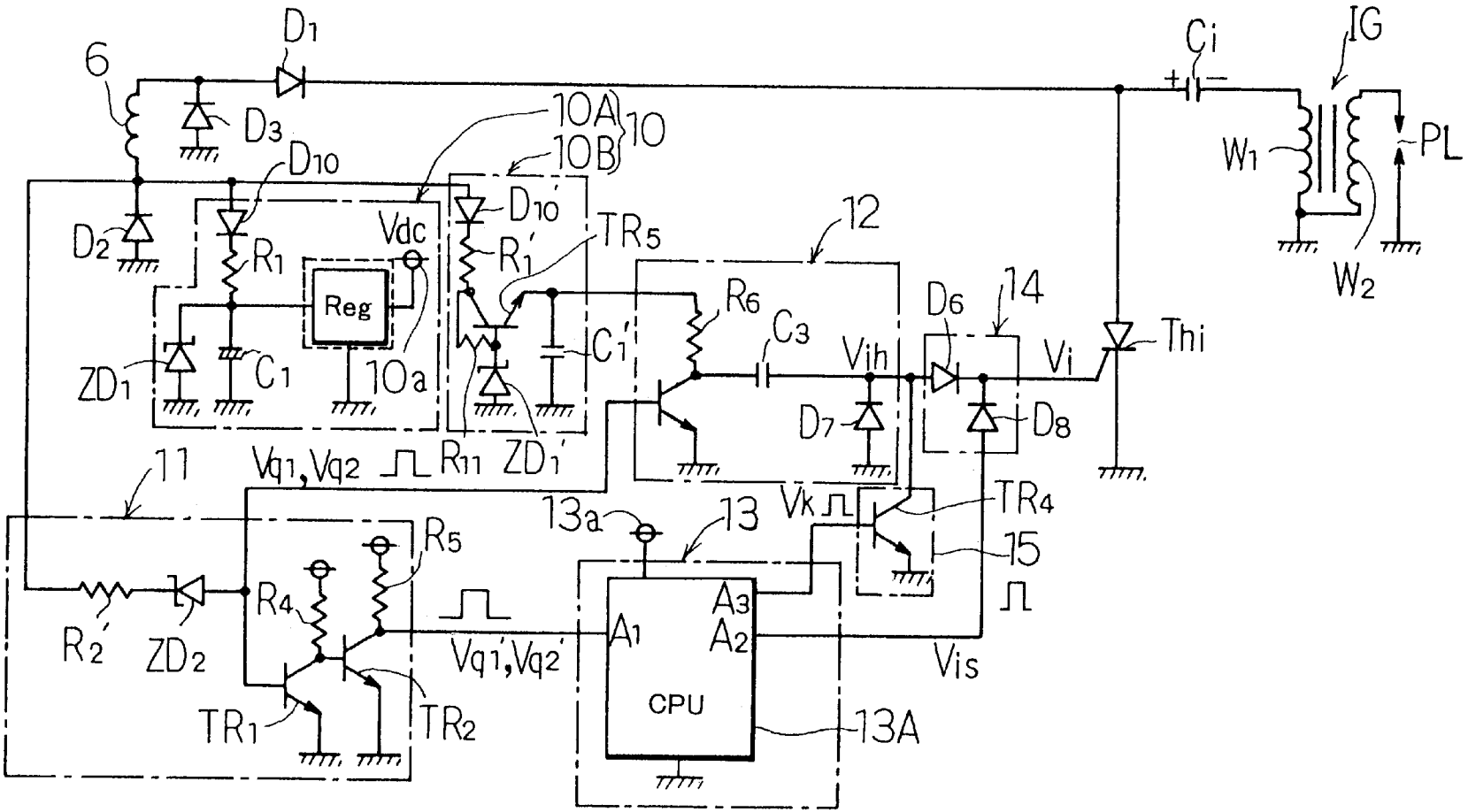
FIG. 2 is a circuit diagram showing an another embodiment of the present invention.

As shown in FIGS. 6A and 6B, in order to generate the first and second pulse signals Vq1 and Vq2 during the first and second negative half-wave output voltages Vn1 and Vn2 exceed the threshold level, for example, as shown in FIG. 2, the other end of the exciter coil 6 may be connected to the base of the NPN transistor TR1 through a resistor R2' and a Zener diode ZD2. In this case, the threshold level Vth can be adequately adjusted by a resistance value of the resistor R2' and a Zener voltage of the Zener diode ZD2.

Further, the second power supply circuit 10B which gives the power supply voltage to the ignition control portion for extremely low speed state 12 is not limited to the circuit shown in FIG. 1, and, for example, as shown in FIG. 2, can be also comprised of a diode D10' whose anode is connected to the other end of the exciter coil 6, an NPN transistor TR5 whose collector is connected to the cathode of the diode through the resistor R1', a resistor R11 connected between the collector and the base of the transistor TR5, a Zener diode ZD1' whose anode is directed to ground side between the base and the ground of the transistor TR5 and the power supply capacitor C1' connected between the emitter and the ground of the transistor TR5.

In the second power supply circuit 10B shown in FIG. 2, the transistor TR5 becomes the on-state when the negative half-wave output voltage of the exciter coil is below the set value, and allows the charging current to flow into a second power supply capacitor C1'. When the negative half-wave output voltage of the exciter coil exceeds the set value, the Zener diode ZD1' becomes the on-state, and the current to be given to the base of the transistor TR5' from the exciter coil through the resistors R1' and R11 is bypassed from the transistor, and, therefore, the transistor TR5' is put into the off-state so as to stop the charging of the capacitor C1'. Consequently, the terminal voltage (the output voltage of the second power supply circuit 10B) of the capacitor C1' is limited below the set value and the second power supply circuit 10B is prevented from outputting an excessive direct current voltage.

In this example, a charging control circuit is comprised of the diode D10', the resistors R1' and R11 and the transistor TR5, wherein the second power supply capacitor C1' is charged when the negative half-wave output voltage of the exciter coil is below the set value, and the charging of the second power supply capacitor C1' is stopped when the negative half-wave voltage of the exciter coil exceeds the set value.

Figure 3:
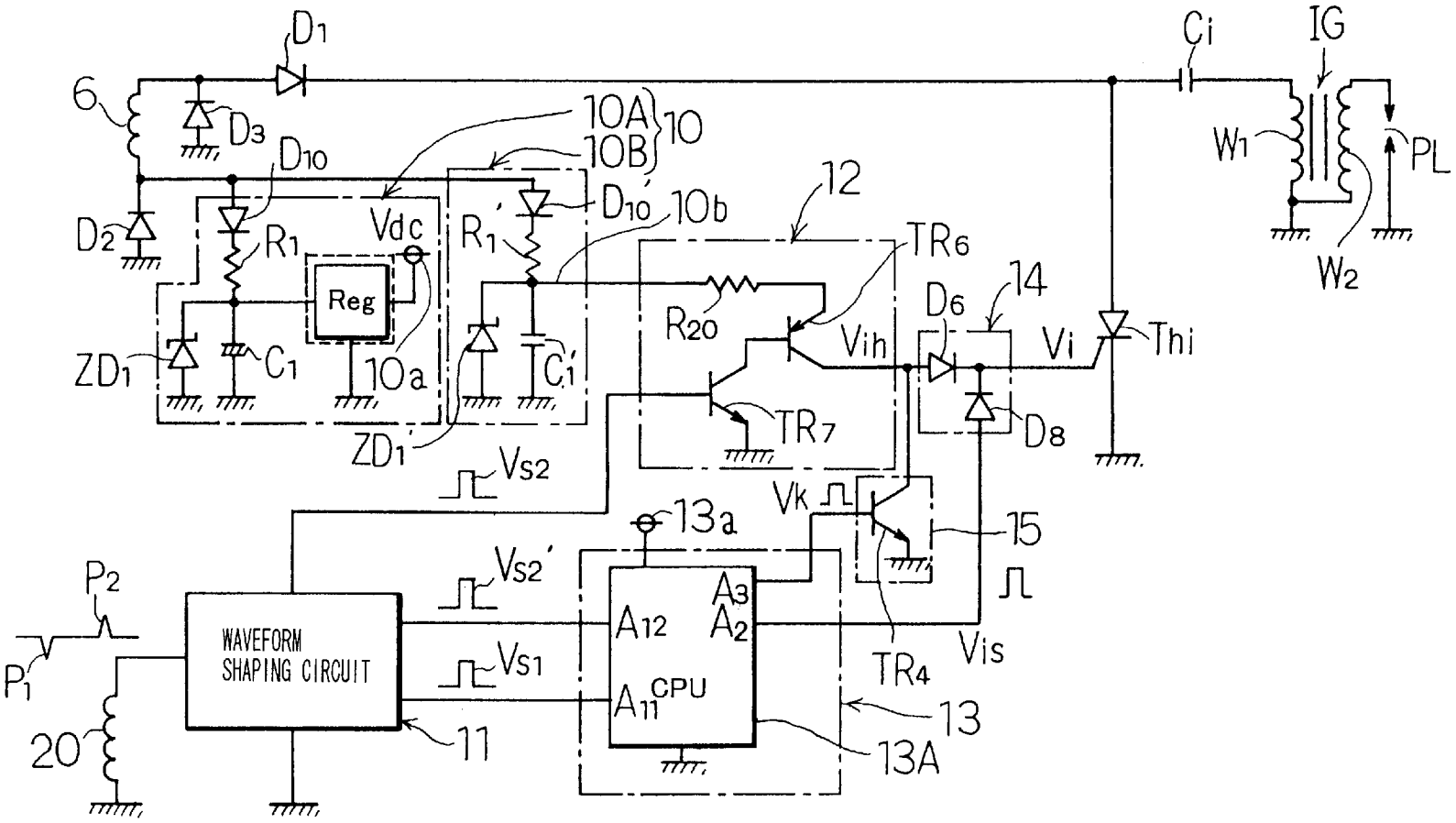
FIG. 3 is a circuit diagram showing still a further embodiment of the present invention.

Since the power supply voltage required for generating the hard ignition signal from the ignition control portion for extremely low speed state 12 may be lower than the voltage (5[V]) required for operating the microcomputer 13A, when a separate power supply is provided for the ignition control portion for extremely low speed state 12 as shown in FIG. 3, the rotational speed (the starting rotational speed) whereby the supply of the hard ignition signal to the discharge thyristor is started is lowered and the starting characteristic of the engine can be improved.

Note that, in the example shown in FIGS. 1 and 2, the circuit (the circuit comprising the diode D10, the resistor R1, the capacitor C1 and the Zener diode ZD1) of the stage portion preceding to the regulator Reg of the first power supply circuit 10A can be also replaced by a circuit having the same constitution as the second power supply circuit 10B shown in FIG. 2.

In the above described example, the signal generating portion is comprised of the exciter coil 6 and the waveform shaping circuit which waveform-shapes the negative half-wave output voltage of the exciter coil and converts it into the pulse signal, and the rising or the falling edge of the pulse signal obtained by waveform-shaping the negative half-wave output voltage of the exciter coil is used as the reference position detection signal or the ignition position detection signal for extremely low speed state. However, the signal generating portion can be also comprised of the signal generator which is mounted on the internal combustion engine and generates the signal pulse at the reference position and the ignition position for extremely low speed state, respectively and the waveform shaping circuit for waveform-shaping the output of the signal generator.

Figure 12A:
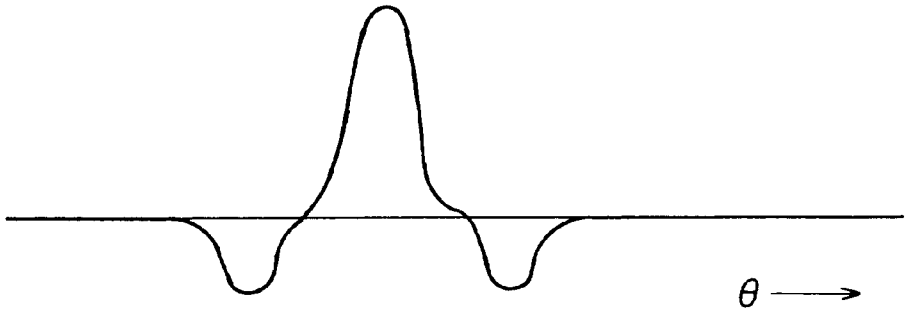
FIG. 12A is a waveform chart of a voltage to be outputted by an exciter coil of an ignition device shown in FIG. 3.
Figure 12B:
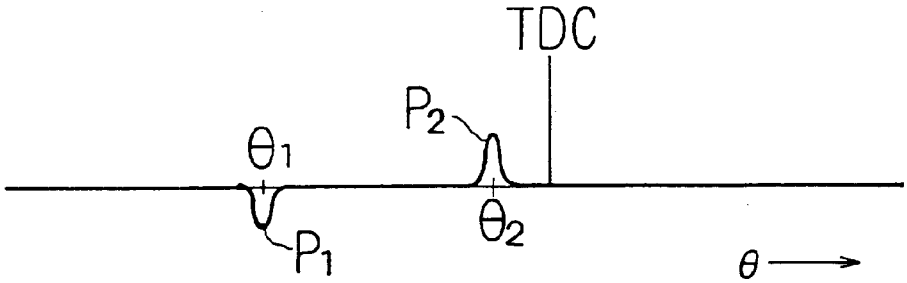
FIG. 12B is a waveform chart showing one example of the waveform of the signal to be outputted by a pulsar coil of the ignition device shown in FIG. 3.

FIG. 3 shows an example wherein the signal generating portion is comprised of the signal generator and the waveform shaping circuit. In FIG. 3, reference numeral 20 denotes a pulsar coil provided in the signal generator which is mounted on the internal combustion engine, and this pulsar coil is provided in the signal generator mounted on the internal combustion engine not shown, and as shown in FIG. 12B, when the rotational angle position θ of the crank shaft of the internal combustion engine corresponds to the reference position θ1 set at the position sufficiently advanced more than a rotational angle position TDC which corresponds to the top dead center of the engine, a first signal P1 having a pulse waveform is generated, and when the rotational angle position of the internal combustion engine corresponds to a position θ2 adequate as the ignition position at the starting time and the extremely low speed state, a second signal P2 having the pulse waveform is generated.

The signal generator comprises, for example, the rotor mounted on the crank shaft and the like having a reluctor and synchronously rotating with the engine, an iron core having a magnetic pole portion opposing to the reluctor of the rotor at its top end, a pulsar coil wound around the iron core and a permanent magnet letting magnetic flux flow to the iron core, and is comprised of a signal armature for generating the signals P1 and P2 of a pulse waveform having a different polarity when the edge of the front end side and the edge of the rear end side in the rotational direction of the reluctor were detected, respectively.

Reference numeral 11 denotes the waveform shaping circuit, which waveform-shapes the first signal P1 and the second signal P2 outputted by a pulsar coil 20, respectively and outputs the reference position detection signal Vs1 and the ignition position detection signals for extremely low speed state Vs2, Vs2'. Among these signals, the ignition position detection signal for extremely low speed state Vs2, similar to the pulse signal Vq2 of the example shown FIGS. 1 and 2, is a signal outputted through the passive element (parallel circuit of a capacitor and a resistor, and a Zener diode) when the input signal P2 exceeds. the threshold value, and is a signal generated immediately after the starting operation of the engine is started. Other signals Vs1 and Vs2' are signals outputted through an amplifier element such as transistor and the like. Among each portion of the waveform shaping circuit 11, the portion generating the signals Vs1 and Vs2' operates with the output voltage of the first power supply circuit 10A as the power supply voltage.

The reference position detection signal Vs1 and the ignition position detection signal for extremely low speed state Vs2' are inputted to the ports A11 and A12 of the microcomputer 13A.

The ignition control portion for extremely low speed state 12 comprises a PNP transistor TR6 whose emitter is connected to an output terminal 20*b* of the second power supply circuit 10B through a resistor R20 and collector is connected to the gate of the discharge thyristor Thi through the diode D6 and an NPN transistor TR7 whose emitter is grounded and collector is connected to the base of the transistor TR6, and the ignition position detection signal for extremely low speed state Vs2 is inputted to the base of the transistor TR7. Other portions are comprised similarly to the ignition device of FIG. 1.

In the example shown in FIG. 3, when the pulsar coil 20 generates the second signal P2 and the waveform shaping circuit 11 generates the ignition position detection signal for extremely low speed state Vs2, the transistor TR7 is put into the on-state. In this way, the transistor TR6 becomes the on-state to give the ignition signal to the discharge thyristor Thi.

The microcomputer 13A detects the rotational speed of the engine from the intervals of the signals Vs1 and Vs2', and arithmetically operates the ignition position in the detected rotational speed. Further, the microcomputer starts the measurement of the ignition position which was arithmetically operated when the reference position detection signal Vs1 was generated, and when the measurement has been finished, the ignition signal Vk is outputted so as to perform the ignition operation.

As described above, according to the present invention, since the power supply circuit provided in the ignition control portion for extremely low speed state for giving the ignition signal to the discharge thyristor at the starting time and the extremely low speed state of the internal combustion engine is separately provided from the power supply circuit for giving the power supply voltage to the ignition control portion for steady state, the extremely low speed state control portion can be operated before the ignition control portion for steady state starts the operation.

Consequently, not only the starting rotational speed of the engine can be lowered to improve the starting characteristic of the engine, but also the rotation in the idling region of the engine can be stably performed.

Although preferred embodiments of the invention have been described and illustrated with reference to the accompanying drawings, it will be understood by those skilled in the art that it is by way of example, and that various changes and modifications may be made without departing from the spirit and scope of the invention, which is defined only to the appended claims.

What is claimed is:

1. A capacitor discharge type internal combustion engine ignition device comprising: an exciter coil provided inside a magneto-generator to be driven by an internal combustion engine; an ignition coil; an ignition capacitor provided in the primary side of said ignition coil and charged by a positive half-wave output voltage of said exciter coil at one polarity; a discharge thyristor to become an on-state when an ignition signal is given to allow a charge of said ignition capacitor to discharge through the primary coil of said ignition coil; a control power supply circuit for converting the output voltage of said exciter coil into a direct current voltage; a signal generating portion for generating a reference position detection signal at a reference position set at a position sufficiently advanced more than a rotational angle position of a crank shaft which corresponds to a top dead center of said internal combustion engine and generating an ignition position detection signal for extremely low speed state at the position adequate as the ignition position at the starting time and the extremely low speed state of said internal combustion engine; an ignition control portion for extremely low speed state for giving the ignition signal to said discharge thyristor when said ignition position detection signal for extremely low speed state is generated; and an ignition control portion for steady state for giving the ignition signal to said discharge thyristor at the ignition position decided based on rotational information on the internal combustion engine obtained from the output signal of said signal generating portion; wherein said ignition control portion for extremely low speed state and said ignition control portion for steady state are comprised in such a manner as to operate with the direct current power supply voltage obtained from said control power supply circuit, wherein said control power supply circuit comprises: a first power supply circuit for generating a constant direct current power supply voltage to allow said ignition control portion for steady state to operate when the output voltage of said exciter coil exceeds a set value and a second power supply circuit for generating the direct current power supply voltage to allow said ignition control portion for extremely low speed state to operate since when the output voltage of said exciter coil is put into a state of being below said set value, and wherein said ignition control portion for extremely low speed state is comprised in such a manner as to start generating said ignition signal when the voltage lower than the power supply voltage of said ignition control portion for steady state is given.

2. A capacitor discharge type internal combustion engine ignition device according to claim 1, wherein said magneto-generator has a rotational body mounted on the crank shaft of the internal combustion engine and one permanent-magnet mounted on an outer periphery of the rotational body, and comprises: a magnetic rotor in which a three pole magnetic field is comprised of said permanent-magnet and an outer periphery portion of said rotor abutting against the permanent-magnet; and a stator having an iron core with a magnetic pole portion opposing to a magnetic field of said magnetic rotor and the exciter coil wound around said iron core and outputting an alternating current voltage of one and a half cycle, where a first negative half-wave voltage and positive half-wave voltage and a second negative half-wave voltage appear in order, from said exciter coil, wherein said signal generating portion comprises: said exciter coil; and a waveform shaping circuit for waveform-shaping the first and the second negative half-wave voltages outputted from the exciter coil, respectively and converting them into a first and a second pulse signals of a rectangular waveform, wherein said magneto-generator is provided in such a manner that a position in which a rising edge position or a falling edge position of said second pulse signal corresponds to a position adequate as the ignition position at the starting time and the extremely low speed state of said internal combustion engine, wherein said control portion for extremely low speed state comprises a hardware circuit, and is comprised in such a manner as to supply said ignition signal to said discharge thyristor by taking each rising edge or falling edge of said first and second pulse signals as said ignition position detection signal for extremely low speed state, and wherein said ignition control portion for steady state is comprised so that a microcomputer operates with the direct current voltage obtained from said first power supply circuit as the power supply voltage and performs an arithmetical operation of the ignition position in each rotational speed of said internal combustion engine, taking the rising edge or the falling edge of said first pulse signal as said reference position detection signal, and the microcomputer gives said ignition signal to said discharge thyristor when the operated ignition position is detected.

3. A capacitor discharge type internal combustion engine ignition device according to claim 2, wherein an ignition signal cancel switch, which becomes an on-state when a cancel command is given and bypasses from said discharge thyristor the ignition signal given to said discharge thyristor from said ignition control portion for extremely low speed state, is further provided, wherein the microcomputer of said ignition control portion for steady state is programmed in such a manner as to comprise reference position detection means for recognizing said first pulse signal and second pulse signal from signal widths of said first and second pulse signals and intervals of the first and second pulse signals and detecting the rising or the falling edge of one of the recognized pulse signals as the reference position, rotational speed detection means for finding data to detect the rotational speed of said internal combustion engine by using at least one of said first and second pulse signals, ignition position arithmetically operating means for arithmetically operating the ignition position of said internal combustion engine for the detected rotational speed in the form of a time required for the crank shaft of the engine to rotate from said reference position to the ignition position, ignition position detection means for starting the measurement of said ignition position when said reference position is detected and giving the ignition signal to said discharge thyristor when the measurement of said ignition position is completed and cancel command generating means for generating said cancel command when the rotational speed of said internal combustion engine exceeds the set value.

4. A capacitor discharge type internal combustion engine ignition device according to claim 2, wherein said ignition control portion for extremely low speed state comprises:

an ignition signal supply capacitor to be charged by the output voltage of said second power supply circuit through a current limiting element and a gate and a cathode of said discharge thyristor; a transistor provided in such a manner as to become an on-state when said first and second pulse signals are given as base signals and bypass a charging current of said ignition signal supply capacitor from the capacitor; and a diode for linking said ignition signal supply capacitor to said transistor so that a charge of said ignition signal supply capacitor is discharged through said transistor when said transistor is put into the on-state; wherein the ignition signal is given to said discharge thyristor at the falling edges of said first pulse signal and second pulse signal.

5. A capacitor discharge type internal combustion engine ignition device according to claim 3, wherein said ignition control portion for extremely low speed state comprises:

the ignition signal supply capacitor to be charged by the output voltage of said second power supply circuit through the current limiting element and a gate and a cathode of said discharge thyristor; a transistor provided in such a manner as to become the on-state when said first and second pulse signals are given as base signals and bypass a charging current of said ignition signal supply capacitor from the capacitor; and a diode for linking said ignition signal supply capacitor to said transistor so that a charge of said ignition signal supply capacitor is discharged through said transistor when said transistor is put into the on-state; wherein the ignition signal is given to said discharge thyristor at the falling edges of said first pulse signal and second pulse signal.

6. A capacitor discharge type internal combustion engine ignition device according to claim 1, wherein said signal generating portion comprises: a signal generator which is mounted on said internal combustion engine and generates a first signal when the rotational angle position of said internal combustion engine corresponds to said reference position and generates a second signal when the rotational angle position of said internal combustion engine corresponds to a position adequate as the ignition position at said starting time and extremely low speed state; and the waveform shaping circuit for waveform-shaping the first signal and the second signal outputted by the signal generator, respectively and outputting said reference position detection signal and ignition position detection signal for extremely low speed state.

* * * * *